US005668580A

United States Patent [19]

Chan et al.

[11] Patent Number: 5,668,580

[45] Date of Patent: Sep. 16, 1997

[54] DE-COUPLEABLE PRINT POSITION INDICATOR

[75] Inventors: Darrell K. Chan, Huntington Beach; Chihsin S. Young, Irvine, both of Calif.

[73] Assignee: Canon Business Machines, Inc., Costa Mesa, Calif.

[21] Appl. No.: 255,995

[22] Filed: Jun. 8, 1994

[51] Int. Cl.[6] ..... B41J 29/42

[52] U.S. Cl. ..... 347/37; 400/705.1; 400/709.2

[58] Field of Search ..... 400/279, 320, 400/322, 328, 352, 353, 354, 705, 705.1, 705.3, 709, 709.1, 709.2; 347/23, 29, 37

[56] References Cited

U.S. PATENT DOCUMENTS

| | | | |
|---|---|---|---|
| 4,264,226 | 4/1981 | Bowles et al. | 400/709.1 |
| 4,867,592 | 9/1989 | Cranford | 400/709 |
| 4,907,018 | 3/1990 | Pinkerpell et al. | 346/139 R |
| 5,040,913 | 8/1991 | Folkens et al. | 400/705 |
| 5,155,499 | 10/1992 | Goetz et al. | 346/1.1 |
| 5,156,478 | 10/1992 | Jobs | 400/705 |

FOREIGN PATENT DOCUMENTS

| | | | |
|---|---|---|---|
| 57-103879 | 6/1982 | Japan | 400/705.1 |
| 60-104376 | 6/1985 | Japan | 400/705.1 |
| 2-171270 | 7/1990 | Japan | 400/709 |
| 2 093 244 | 8/1982 | United Kingdom | 400/705.1 |

*Primary Examiner*—David A. Wiecking

*Attorney, Agent, or Firm*—Fitzpatrick, Cella, Harper & Scinto

[57] ABSTRACT

A print position indicator is coupleable to and uncoupleable from a print head so that the print position indicator can continuously indicate the next print position even when the print head is not adjacent that position. The print position indicator is slidably mounted on the same guide rail that carries the print head for left-and-right movement and includes a coupling mechanism so that the print position indicator can be detached from the print head when the print head returns to a home position, leaving the print position indicator correctly pointing to the next print position. In addition, the print position indicator can include plural laterally extending indicators, such as a row of light-emitting diodes (LED's) which are sequentially activated so as to indicate the next print position when plural characters are input before any of them are printed.

43 Claims, 16 Drawing Sheets

DE-COUPLEABLE PRINT POSITION INDICATOR

BACKGROUND OF THE INVENTION

1. Field of the Invention

The present invention relates to a print position indicator which indicates the position at which a print head will next print on a recording medium. More specifically, the present invention relates to a print position indicator which is coupleable to and uncoupleable from a print head so as to continue to indicate the next print position, even when the print head is no longer adjacent the next print position.

2. Description of the Related Art

In typewriters and printers (both hereinafter referred to as "printers") of the type where the print head rather than the recording medium moves, conventional print position indicators are ordinarily fixed to the print head. As the print head travels across the recording medium, the print position indicator moves with it so as to continuously indicate where the print head will next print.

Fixing the print position indicator to the print head, however, is disadvantageous for printers of a more recent type in which the print head is not always adjacent to the next print position. For example, non-impact type printers, such as ink jet printers, print by ejecting heated ink droplets out of ink nozzles in patterns that form desired letters and symbols onto the recording medium. These ink nozzles dry out and/or clog if exposed to air without printing. To prevent such drying out, a capping mechanism is provided at a "home" position, usually the left-most carriage position of the print head, and the print head is periodically returned to the capping mechanism when more than 5 seconds elapse since printing has occurred. But, because the position indicator is fixed to the print head, it also moves to the capping mechanism giving an erroneous indication of the next print position.

Even more recently, some ink jet printers have been developed which store a certain number of input characters before printing any of them and then print all the stored characters at once. Since the print head does not move until the characters are printed, print position indicators that are fixed to the print head again give an erroneous indication of the next print position. As a result, large numbers of characters may be printed without their position being indicated.

Thus, there is a need for a position indicator that indicates the print position even when the print head is not adjacent the next print position. There is also a need for a position indicator that permits the print head to stay at the home position while indicating the print position of plural characters that have been input but not yet printed.

SUMMARY OF THE INVENTION

The present invention addresses the above situation by providing a print position indicator that indicates the next print position even when the print head is no longer adjacent the next print position.

According to one aspect of the invention, a print position indicator is coupleable to and uncoupleable from a print head so that the print position indicator can continuously indicate the next print position even when the print head is not adjacent that position. The print position indicator may be mounted to slide on the same guide rail that carries the print head for left-and-right movement and may include a coupling mechanism so that the print position indicator can be detached from the print head when the print head returns to the home position, leaving the print position indicator correctly pointing to the next print position. In addition, the print position indicator can include plural laterally extending indicators, such as a row of light-emitting diodes (LED's), which are sequentially activated so as to indicate the next print position when plural characters are input before any of them are printed.

A printer according to the invention includes a carrier guide rail and a capping mechanism mounted at a home position of the carrier guide rail. An ink jet print head and a print position indicator are both slidably mounted on the guide rail for left-and-right movement adjacent a recording medium or adjacent a platen for such a recording medium. A coupling mechanism is provided to couple the print position indicator to the print head and to detach it therefrom. Under control by control means, the coupling mechanism is caused to couple the position indicator to the print head, and the print head is caused to move along the guide rail while printing characters which may be input via a keyboard. When no printing occurs for a predetermined time such as five seconds, the control means causes the coupling mechanism to detach the print position indicator from the print head and to move the print head to the home position where the capping mechanism is activated to cap the print head. The print position indicator is left at that position on the guide rail to indicate the next print position.

The control means may also be constructed so as to detect when a "return" key has been depressed, and in response thereto, to cause the print head to return to where the print position indicator was left, activate the coupling mechanism, and return the print head and the print position indicator to a margin position so that the position indicator correctly indicates the next print position.

According to another aspect of the invention, the print position indicator may be constructed by a laterally extending array of plural indicators such as plural LED's which are actuatable so as to illuminate where on the recording medium the next print operation will occur. In this arrangement, the control means is constructed so that it causes the LED's to be sequentially illuminated to indicate the next print position in those instances when characters are input without printing as when the print head is at the home position or when a spell verify mode is selected in which a word is not printed until it has been completely input and its spelling is verified.

These and other features and advantages of the present invention will be more readily understood by reference to the following detailed description of preferred embodiments taken in conjunction with the attached drawings.

DETAILED DESCRIPTION OF PREFERRED EMBODIMENTS

[I. Structure]

Figure 1A:
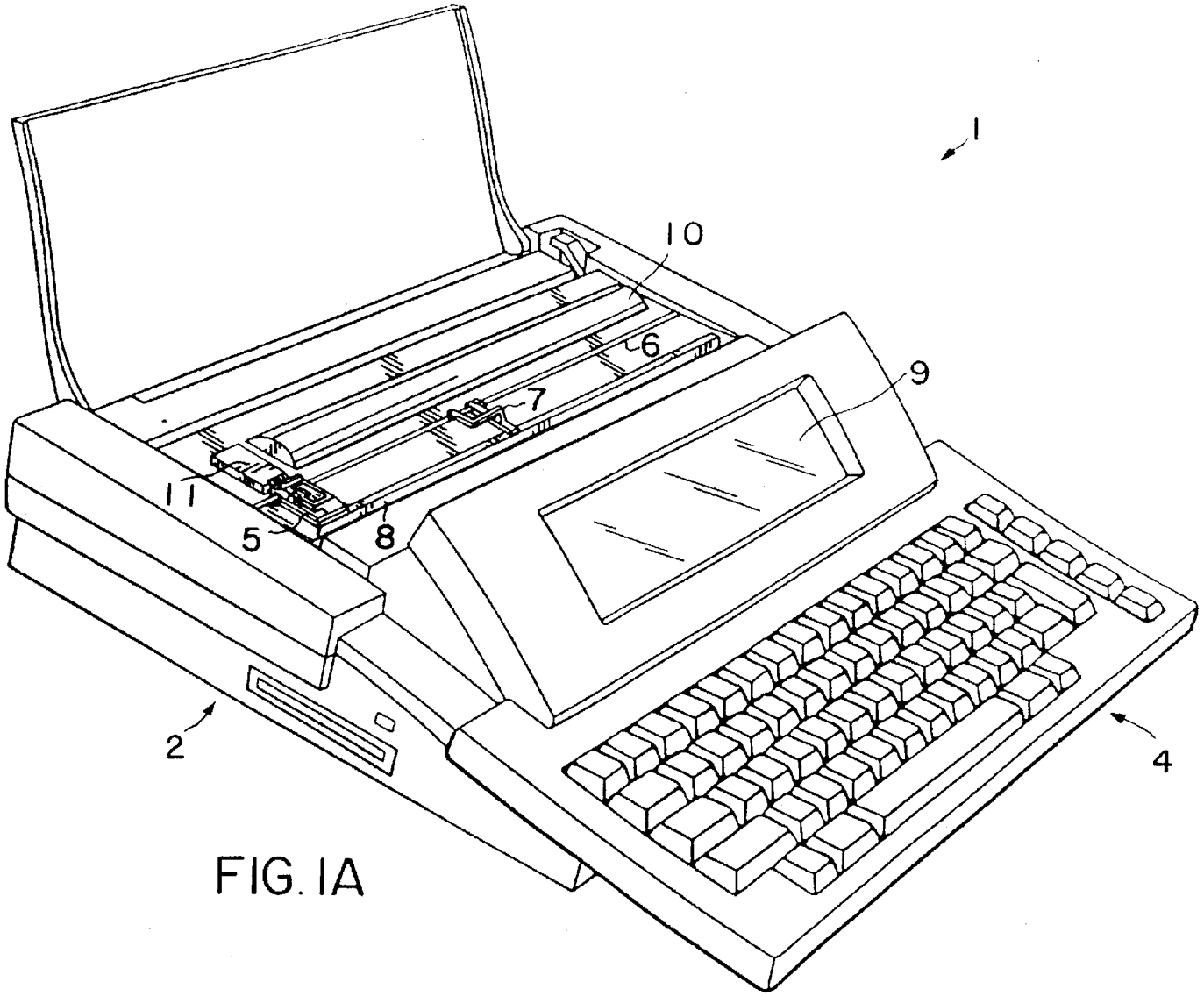
FIGS. 1A and 1B are perspective views of a printer embodying the present invention.

As seen in FIG. 1A, the present invention is embodied in an ink jet printer 1. The ink jet printer 1 can comprise, for example, Canon Ink Jet Printer Model Number BJ 200 or Canon Ink Jet Printer Model Number BJ 10E. However, it should be understood that the present invention can be applied to any type of printer to which it is desirable to attach a position indicator for indicating the next print position.

The printer 1 comprises a frame 2, an input device such as a keyboard 4, a printing assembly 5, a guide rail 6, a print position indicator 7, a retaining rail 8, a display screen 9 comprising a liquid crystal display, a platen 10, and a print head capping mechanism 11. The frame 2 supports all the other elements of the printer 1.

The keyboard 4 includes character keys, numeral keys, and symbol keys for inputting character data, numeral data, and symbol data, respectively. When a sufficient amount of data of this type is inputted into the printer 1, the printing assembly 5 is coupled to the print position indicator 7, as will be discussed in more detail below. It should be noted that all of this data is treated the same for the purpose of determining when to couple the printing assembly 5 to the print position indicator 7. Accordingly, to simplify the discussion below, characters, numerals, and symbols will all be referred to as "characters" in the plural, and a "character" in the singular.

The keyboard 4 also includes a backspace key, a return key, a space key, and a variety of function keys, as are well known to those skilled in the art. The function keys include keys for selecting the printing mode and a spell verify mode, and the font of characters to be printed. With the print mode keys the user can select a character-by-character mode, in which characters are printed as they are inputted, or a queue mode, in which characters are not printed until a predetermined number of characters are inputted.

The printing assembly 5 and the print position indicator 7 are slidably mounted for left-and-right movement on the guide rail 6 adjacent a recording medium, such as paper (not shown) fed by the platen 10. As shown in FIG. 1A, the printing assembly 5 and the print position indicator 7 are uncoupled and spaced from each other, with the printing assembly 5 located at a home position to the left of the left margin and the platen 10. The next position at which the printing assembly 5 will print or refrain from printing is indicated by the print position indicator 7. Thus, the print position indicator 7 can indicate the next print position even when the printing assembly 5 is no longer adjacent the next print position.

The print position indicator 7 is positioned to the right of the printing assembly 5 so that the printing assembly 5 can push the print position indicator 7 to the right as the printing assembly 5 prints from left to right. In this manner, the print position indicator 7 is configured to continuously indicate the next print position.

The printing assembly 5 can also be coupled to the print position indicator 7 and pull the print position indicator 7 to the left, as will be discussed in more detail below. Otherwise, the print position indicator 7 remains stationary.

The retaining rail 8 contacts the bottom of the printing assembly 5 and the print position indicator 7 to ensure the proper orientation of the printing assembly 5 and the print position indicator 7 with respect to the recording medium fed by the platen 10. The display screen 9 displays the characters input by the keyboard 4.

The print head capping mechanism 11 is located at the home position. The print head capping mechanism 11 is configured to engage a portion of the printing assembly 5 in an air tight manner when activated and when the printing assembly 5 is at the home position, as shown in FIG. 1A.

Figure 1B:
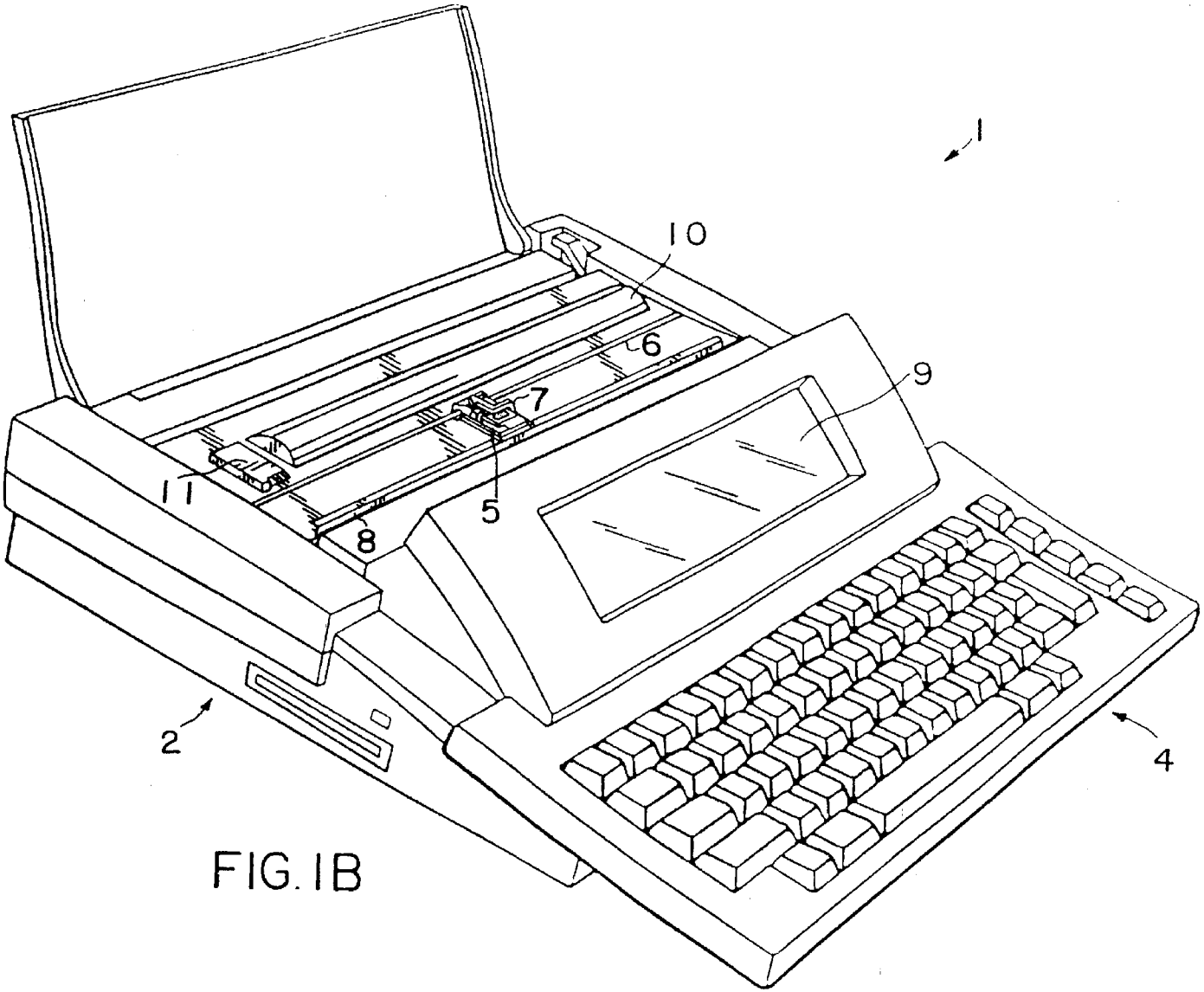

FIG. 1B is identical to FIG. 1A, except that, rather than being located at the home position engaging the print head capping mechanism 11, the printing assembly 5 is shown to be adjacent the print position indicator 7, ready to print at the next print position.

Figure 2A:
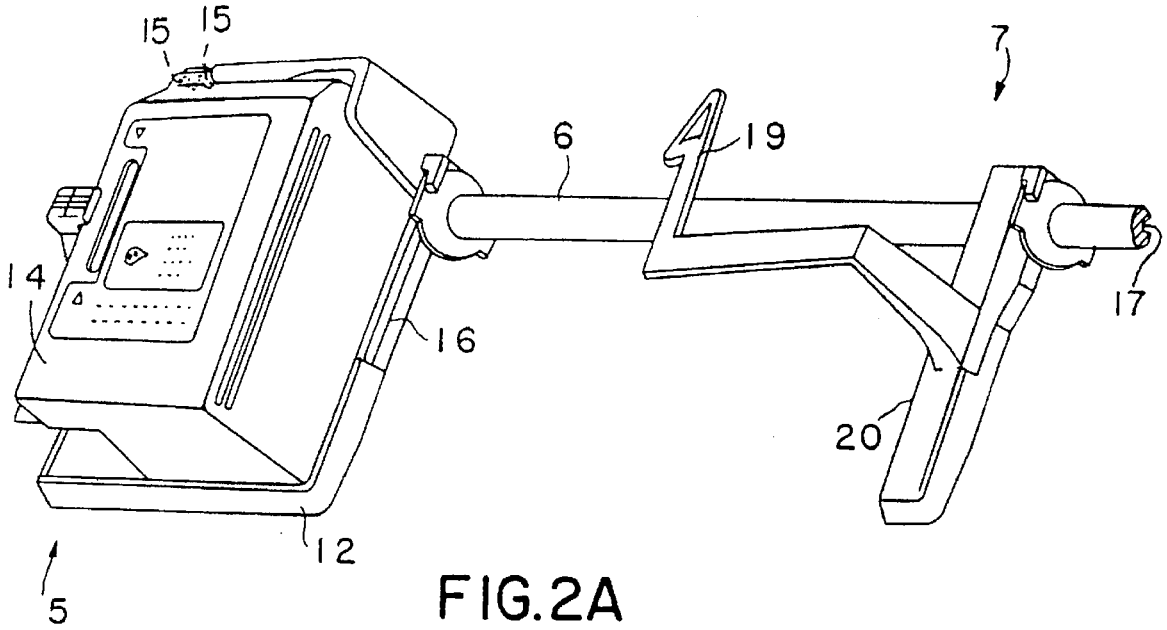
FIGS. 2A and 2B are perspective views of one embodiment of the position indicator of the present invention.

FIG. 2A shows the printing assembly 5, the guide rail 6, and one embodiment of the print position indicator 7 in more detail. As shown in FIG. 2A, the printing assembly 5 comprises a print head carrier 12, a print head 14, nozzles 15, and an electromagnet 16; the guide rail 6 comprises a groove 17; and the print position indicator 7 comprises an arm 19 and a coupling element 20 integral therewith.

The print head carrier 12 is the element of the printing assembly 5 that slidably engages the guide rail 6 to perform left-and-right movement thereon. The print head carrier 12 supports the print head 14 and the electromagnet 16.

The print head 14 is an ink jet print head which ejects ink out of the nozzles 15 onto the recording medium. It should be understood that although only two nozzles 15 are shown, a larger number of nozzles can be used, as is known to those of ordinary skill in the art. When the printing assembly 5 is located at the home position, the print head capping mechanism 11 engages the nozzles 15 of the print head 14 in an air tight manner to prevent the nozzles 15 from clogging up and drying out when the print head 14 is not printing. The print head 14 is moved to the home position for capping whenever it is not printing and a predetermined time, shorter than the print head's dry out time, has elapsed, as will be discussed in more detail below.

The print position indicator 7 indicates the next print position by pointing to the next print position with the end of its arm 19. For this purpose, the end of the arm 19 is in the shape of part of the head of an arrow and is positioned above the print head 14. The coupling element 20 of the print position indicator 7 is composed of a material that is attracted to the electromagnet 16 when the electromagnet 16 is turned on. Preferably, this material is steel. The remainder of print position indicator 7 is preferably composed of plastic. However, it is within the scope of the present invention for the entire print position indicator 7 to be composed of steel or for the coupling element 20 or the entire print position indicator 7 to be composed of some other material containing iron that is attracted to the electromagnet 16 when the electromagnet 16 is turned on.

Figure 2B:
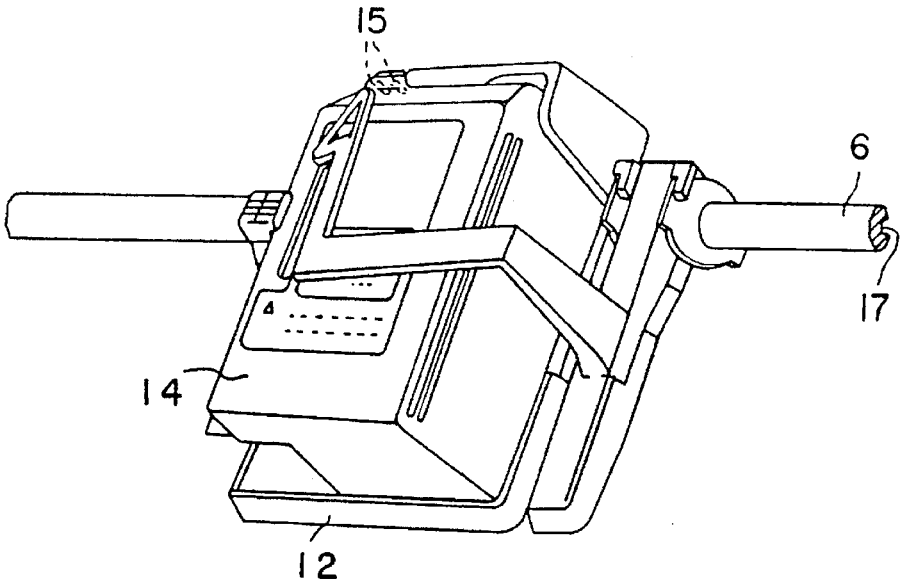

FIG. 2A shows the print position indicator 7 and the printing assembly 5 spaced from each other. FIG. 2B is identical to FIG. 2A, except that the print position indicator 7 and the printing assembly 5 contact each other.

When the electromagnet 16 is turned on, and the print position indicator 7 and the print head carrier 12 are adjacent each other as shown in FIG. 2B, the electromagnet 16 attracts the coupling element 20, thereby coupling the print position indicator 7 to the printing assembly 5. As a result, when the print head carrier 12 moves to the left, the print position indicator 7 will also move to the left. On the other hand, when the electromagnet 16 is turned off, it no longer attracts the coupling element 20, thereby uncoupling the print position indicator 7 and the printing assembly 5. Thus, the electromagnet 16 and the coupling element 20 together comprise a coupling mechanism for detachably coupling the printing assembly 5 and the print position indicator 7.

As seen in FIGS. 2A and 2B, the groove 17 in the guide rail 6 is adapted to mate with a corresponding projection (not shown) of the print head carrier 12 and the print position indicator 7 to ensure the proper orientation thereof with respect to the platen 10 and the recording medium. This structure can be provided in addition to or as an alternative to the retaining rail shown in FIGS. 1A and 1B.

Although FIGS. 2A and 2B show the electromagnet 16 recessed slightly from the outer edge of the print head carrier 12, thereby resulting in a small gap between electromagnet 16 and coupling element 20 when the printing assembly 5 abuts the print position indicator 7, it is within the scope of the present invention for the electromagnet 16 to be flush with the surface of the print head carrier 12 so as to physically contact the coupling element 20 when the print position indicator 7 abuts the print head carrier 12.

Figure 3A:
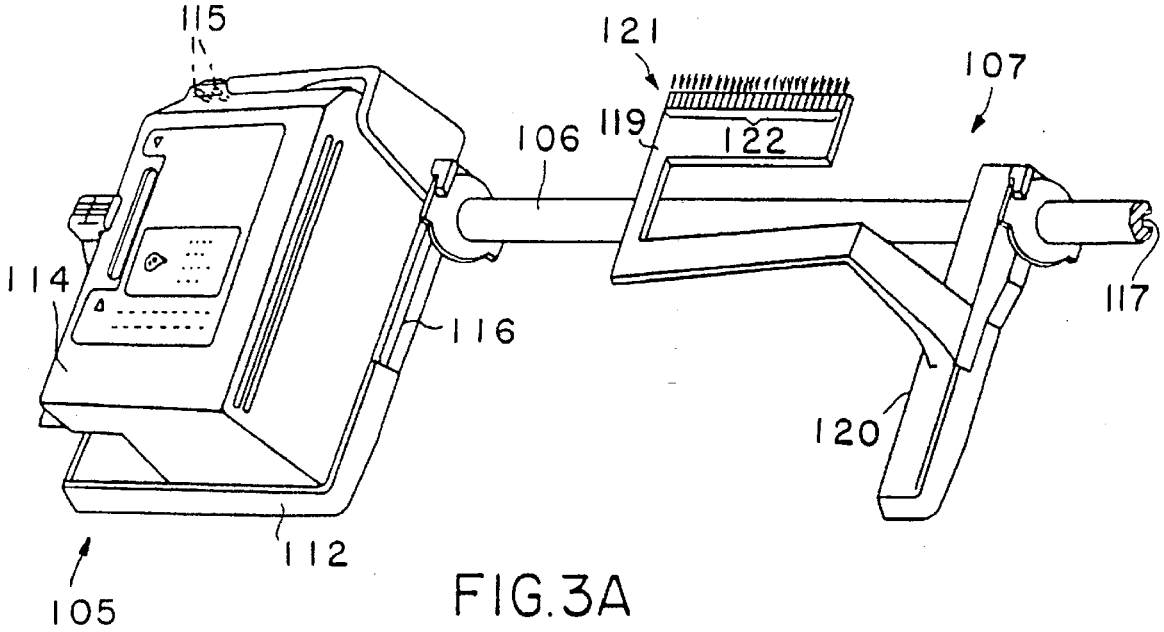
FIGS. 3A and 3B are perspective views of an alternative embodiment of the position indicator of the present invention.
Figure 3B:
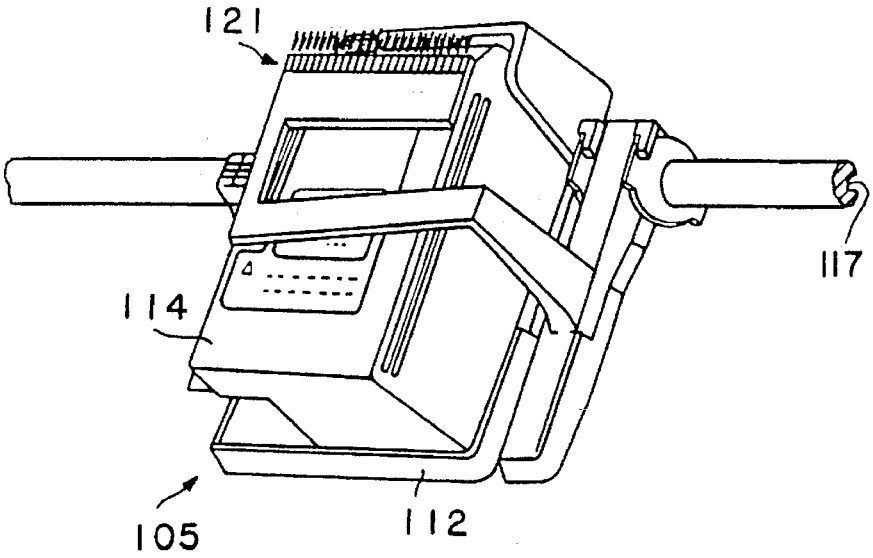

FIGS. 3A and 3B show a second embodiment for the print position indicator 7. More specifically, FIG. 3A shows a printing assembly 105, a guide rail 106, and a print position indicator 107. The printing assembly 105 comprises a print head carrier 112, a print head 114, ink jet nozzles 115, and an electromagnet 116. The guide rail 106 comprises a groove 117, and the print position indicator 107 comprises an arm 119, a coupling element 120, and a light source 121 comprising a laterally extending one-dimensional array of a plurality of light emitting diodes 122. The structure and function of the printing assembly 105, the guide rail 106, and the coupling element 120 shown in FIG. 3A are the same as the corresponding printing assembly 5, the guide rail 6, and the coupling element 20, respectively, shown in FIGS. 2A and 2B. As a result, no further discussion of these elements is provided. FIG. 3B is identical to FIG. 3A, except that in FIG. 3A the print position indicator 107 is spaced from the printing assembly 105, while in FIG. 3B the print position indicator 107 contacts the printing assembly 105.

The light source 121 is attached by the arm 119 to the coupling element 120. The light source 121 is configured to indicate a plurality of next print positions at which printing will next occur. Only the first of these next print positions is adjacent the print position at which the print head 114 is located. The remainder of the next print positions are not adjacent to the print head 114. Thus, the print position indicator 107 can indicate a next print position even when the print head is not adjacent that next print position. A particular next print position is indicated by illuminating a predetermined number of light emitting diodes 122 closest to that next print position. As shown in FIG. 3B, the length of the array is substantially equal to the width of the print head 114. However, it is within the scope of the present invention for the length of the array to be shorter than the width of the print head 114 or longer than the width of the print head 114.

Figure 5A:
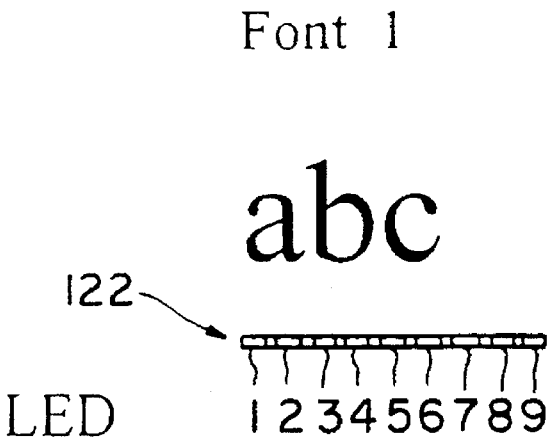
FIGS. 5A and 5B are schematic diagrams of a light emitting diode array illuminating characters having small and large font sizes.
Figure 5B:
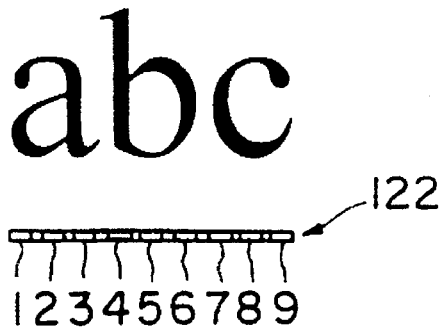

Depending upon the font of a character to be printed, different numbers of light emitting diodes 122 must be illuminated to indicate a next print position. This is illustrated in FIGS. 5A and 5B. FIG. 5A shows an array comprising nine light emitting diodes 122, and letters "a", "b", and "c" to be printed in a small font #1. FIG. 5B shows the same array of nine light emitting diodes 122, and letters "a", "b", and "c" to be printed in a large font #2. For the small font #1 shown in FIG. 5A, two light emitting diodes 122 are needed to illuminate each next print position, while for the large font #2, shown in FIG. 5B, three light emitting diodes 122 must be illuminated to indicate each next print position.

Figure 4A:
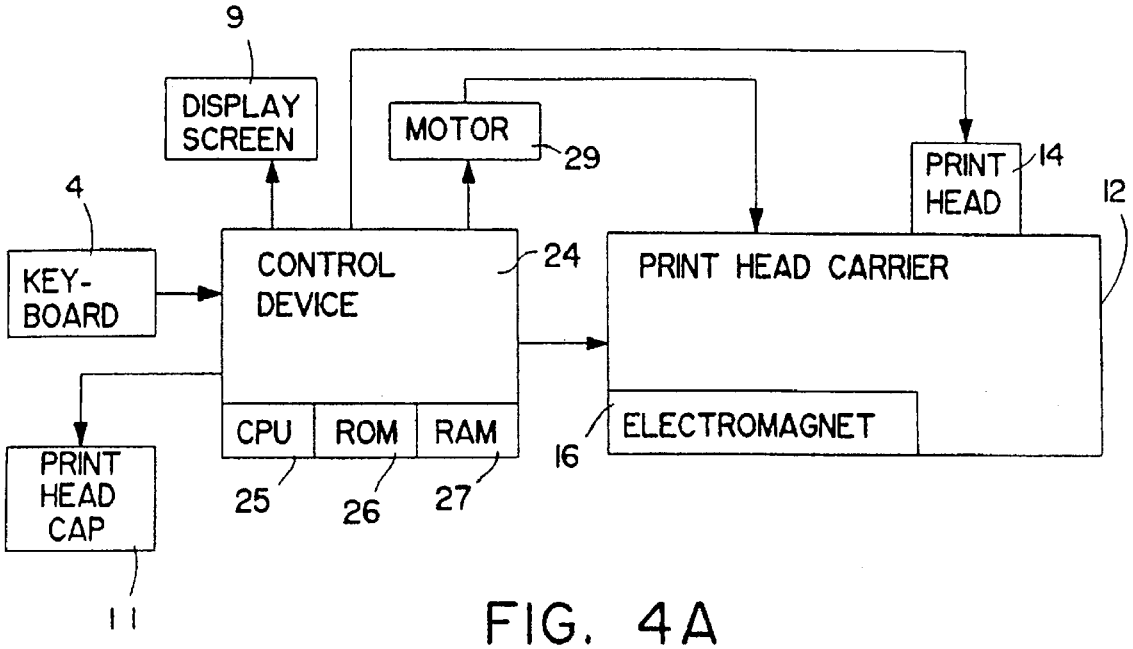
FIGS. 4A, 4B, 4C, and 4D are schematic block diagrams of portions of different embodiments of the present invention.

FIG. 4A shows the control structure and other elements used with the embodiment of the print position indicator shown in FIGS. 2A and 2B. More specifically, FIG. 4A shows the keyboard 4, the display screen 9, the print head capping mechanism 11, the print head carrier 12, the print head 14, and the electromagnet 16 all connected to a control device 24. The control device 24 comprises a central processing unit (CPU) 25, a read-only memory (ROM) 26, and a random access memory (RAM) 27. In addition a motor 29 is connected to the control device 24 and to the print head carrier 12.

The CPU 25 operates according to programs stored in the ROM 26. The RAM 27 stores various types of information including data inputted by the keyboard 4. The control device 24 preferably comprises a Toshiba integrated circuit, model number TLCS 90.

The CPU 25 controls the actuation of the motor 29, which, in turn, controls the movement of the printing assembly 5. The CPU 25 also controls the actuation of the electromagnet 16. In addition, the CPU 25 controls the other functions of the printer 1. These other functions include receiving and processing data input from the keyboard 4, controlling the displaying of input data on the display screen 9, controlling the activation of the print head capping mechanism 11, controlling the printing operations of the print head 14, controlling the selection of the font and the selection of the print mode, controlling the selection and operation of the spell verify mode, and controlling a paper feed mechanism (not shown) to feed paper at the appropriate times with the platen 10.

Figure 4B:
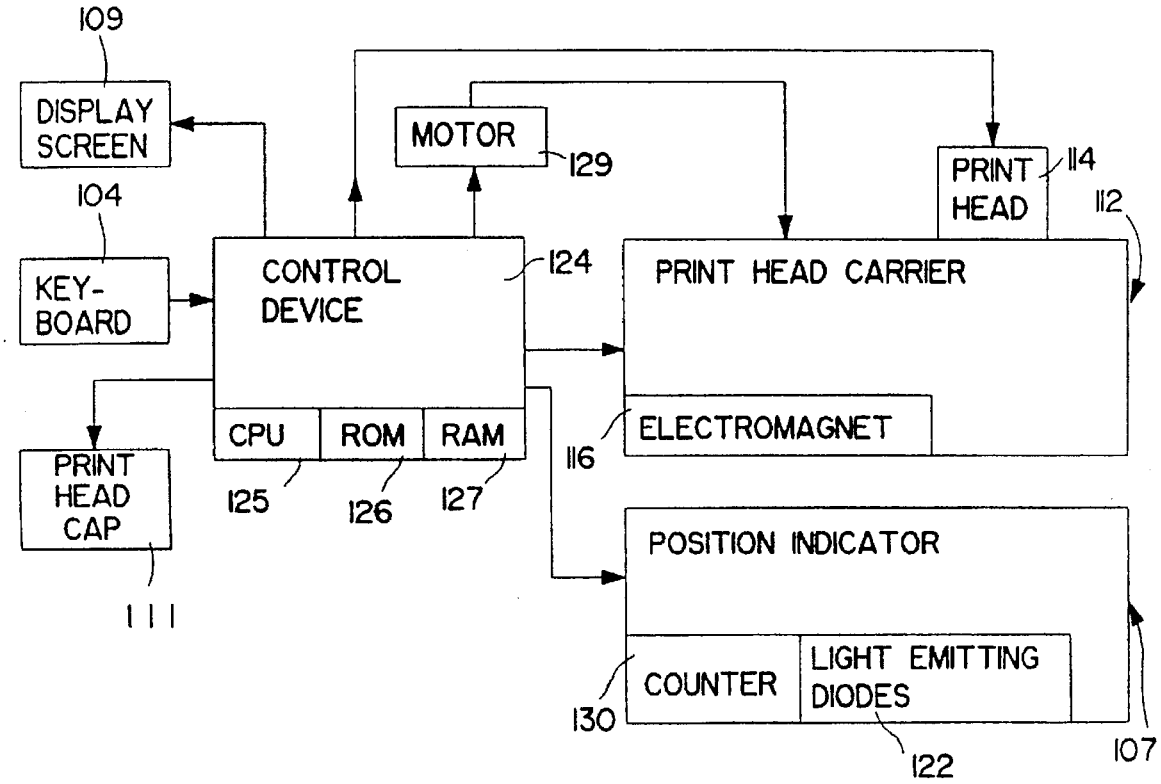

FIG. 4B shows the control structure and other elements used with the embodiment shown in FIGS. 3A and 3B. More specifically, FIG. 4B shows a keyboard 104, a print position indicator 107, a display screen 109, a print head capping mechanism 111, the print head carrier 112, the print head 114, the electromagnet 116, and the light emitting diodes 122 all connected to a control device 124. The control device 124 comprises a central processing unit (CPU) 125, a read-only memory (ROM) 126, and a random access memory (RAM) 127. In addition, a motor 129 is connected to the control device 24 and to the print head carrier 112. Also provided is a counter 130, as part of the print position indicator 107, which is connected to the control device 124.

Although only one line is shown connecting the control device 124 to the counter 130, it should be understood that five lines are in fact preferred to be used. These includes a power line, a ground line, a count line, a count-up/count-down line, and a clear line.

The structure and function of the keyboard 104, the display screen 109, the print head capping mechanism 111, the print head carrier 112, the print head 114, the electromagnet 116, the control device 124, the CPU 125, the ROM 126, the RAM 127, and the motor 129 shown in FIG. 4B are the same as the corresponding elements shown in FIG. 4A, except that the CPU 125 also controls the illumination of the light emitting diodes 122 according to a program stored in the ROM 126. Specifically, the counter 130 and its associated circuitry illuminate the light emitting diodes 122 under the control of the CPU 125.

Figure 4C:
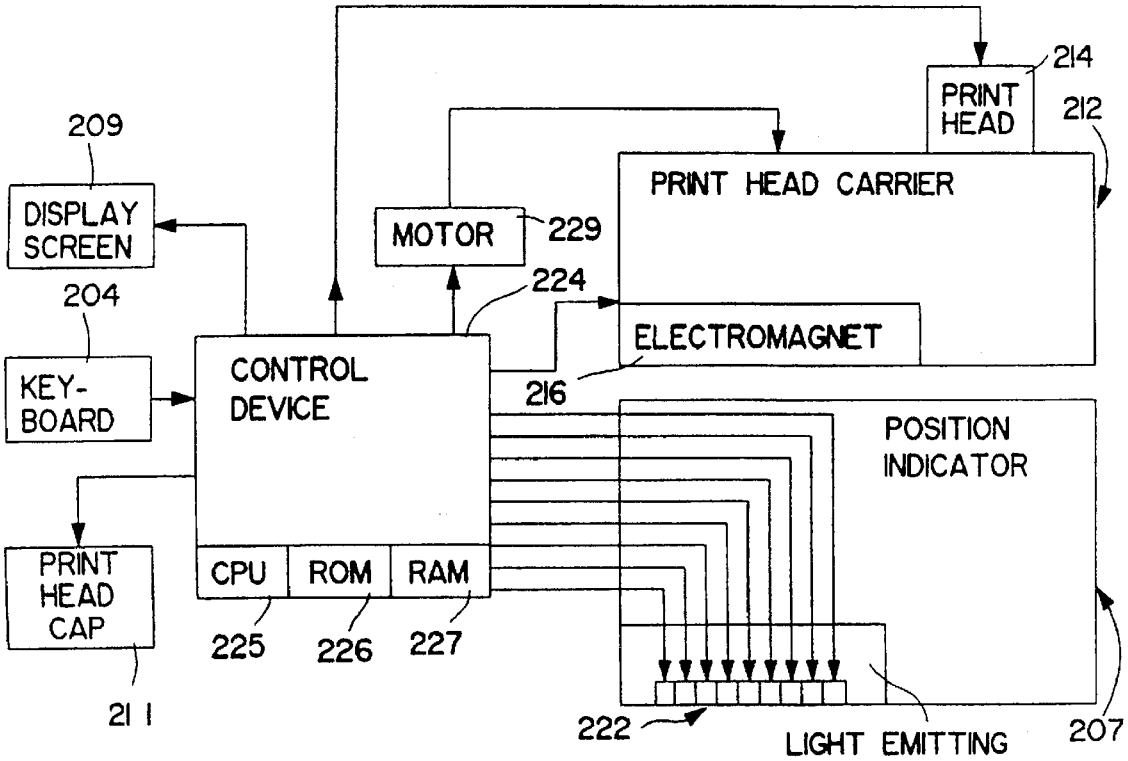

Alternatively, a counter need not be provided with the print position indicator. This embodiment is shown in FIG. 4C. More specifically, FIG. 4C shows a keyboard 204, a print position indicator 207, a display screen 209, a print head capping mechanism 211, a print head carrier 212, a print head 214, an electromagnet 216, and light emitting diodes 222 all connected to a control device 224. The control device 224 comprises a central processing unit (CPU) 225, a read-only memory (ROM) 226, and a random access memory (RAM) 227. In addition, a motor 229 is connected to the control device 224 and to the print head carrier 212.

The structure and function of the keyboard 204, the display screen 209, the print position indicator 207, the print head capping mechanism 211, the print head carrier 212, the print head 214, the electromagnet 216, the light emitting diodes 222, the control device 224, the CPU 225, the ROM 226, the RAM 227, and the motor 229 shown in FIG. 4C are the same as the corresponding elements shown in FIG. 4B, except as noted below.

In this embodiment, because a counter is not provided, separate control lines must be used to connect the CPU 225 to each light emitting diode 222. Thus, for example, in an embodiment in which two light emitting diodes 222 are needed to illuminate each next print position, if the print position indicator 207 is constructed to illuminate ten next print positions, twenty light emitting diodes are needed and twenty control lines must be provided between the CPU 225 and the light emitting diodes 222. Because this embodiment requires so many control lines, the embodiment shown in FIG. 4B using the counter 130 as part of the position indicator 107 is preferred.

Figure 4D:
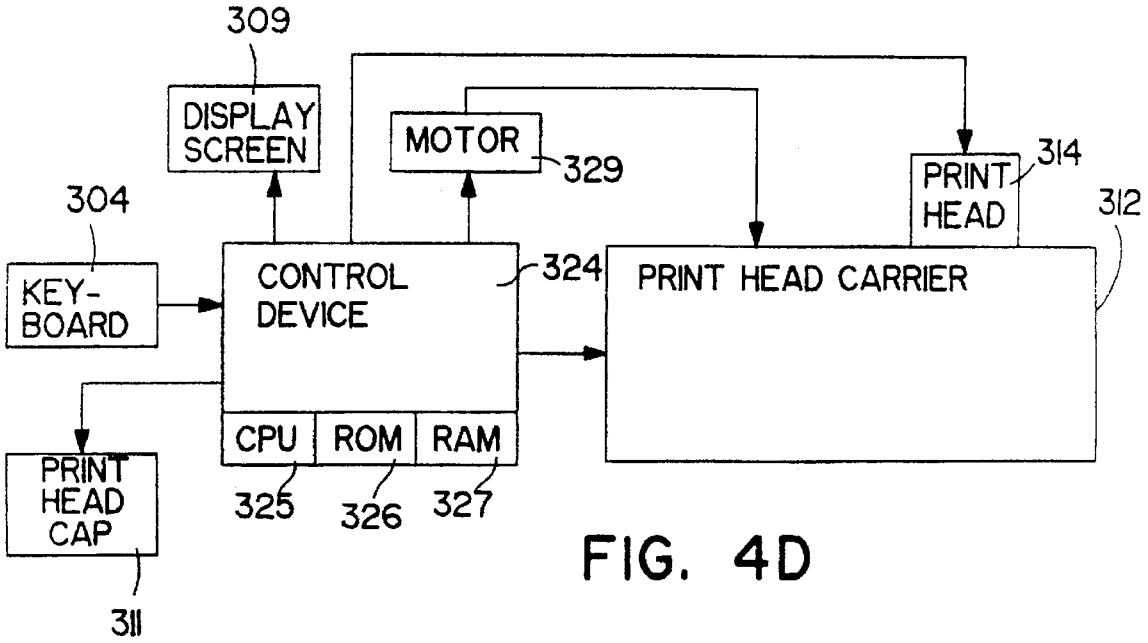

FIG. 4D shows the control structure and other elements for another embodiment of the present invention. More specifically, FIG. 4D shows a keyboard 304, a display screen 309, a print head capping mechanism 311, a print head carrier 312, and a print head 314, all connected to a control device 324. The control device 324 comprises a central processing unit (CPU) 325, a read-only memory (ROM) 326, and a random access memory (RAM) 327. In addition a motor 329 is connected to the control device 324 and to the print head carrier 312.

The structure and function of the keyboard 304, the display screen 309, the print head capping mechanism 311, the print head carrier 312, the print head 314, the control device 324, the CPU 325, the ROM 326, the RAM 327, and the motor 329 shown in FIG. 4D are the same as the corresponding elements shown in FIG. 4A, except as noted below. As a result, no further discussion of these elements is provided, except as it relates to the differences with the embodiment shown in FIG. 4A.

FIGS. 2A, 2B, 3A, and 3B show a first embodiment of the coupling mechanism for coupling and uncoupling the print position indicators 7 and 107 to and from the printing assemblies 5 and 105, respectively. A second embodiment of the coupling mechanism for coupling and uncoupling the position indicator and the printing assembly is shown in FIGS. 6A–6G. This embodiment is to be used with the structure illustrated in FIG. 4D.

Figure 6A:
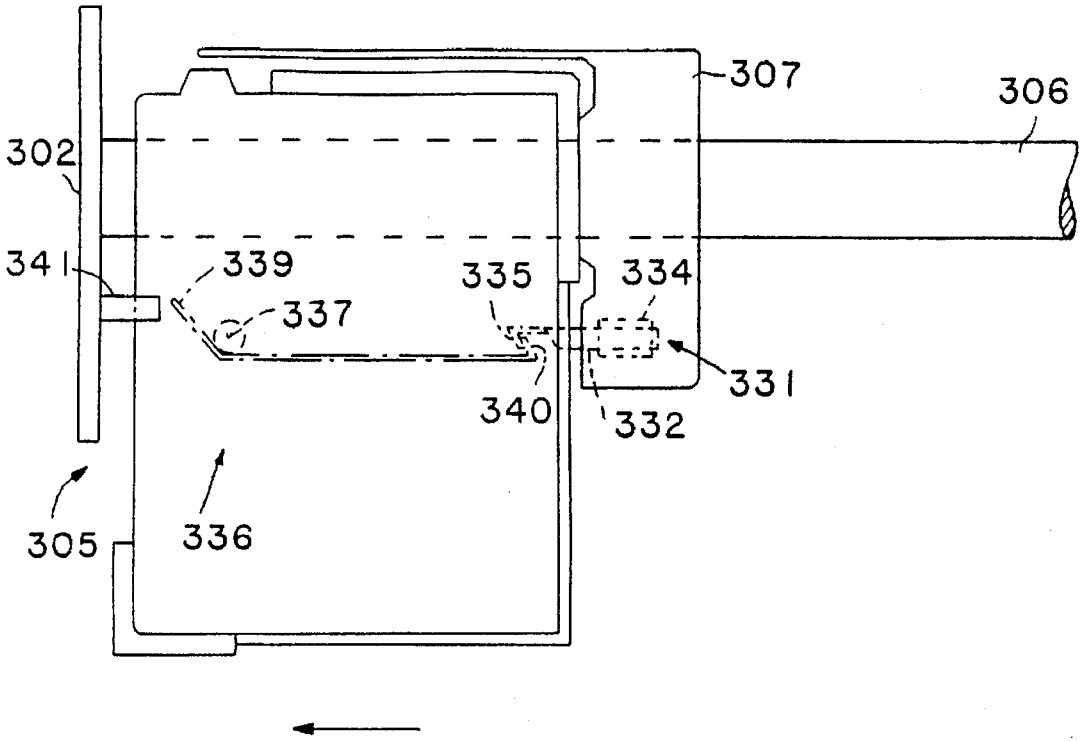
FIGS. 6A, 6B, 6C, 6D, 6E, 6F and 6G are schematic top views of an alternative embodiment of a control device of the present invention for controlling the coupling and uncoupling of a printing assembly and a print position indicator.

FIG. 6A illustrates a left wall of a frame 302, the printing assembly 305, a guide rail 306, and a print position indicator 307. Attached to bottom of the print position indicator 307 is a coupling element 331 comprising a pin 332, a cylindrical housing 334, and a hook 335. Attached to the bottom of the printing assembly 305 is a coupling element 336 comprising a spring 337, an end portion 339, and a hook 340. Attached to the left wall of the frame 302 is an uncoupling stud 341.

Figure 6B:
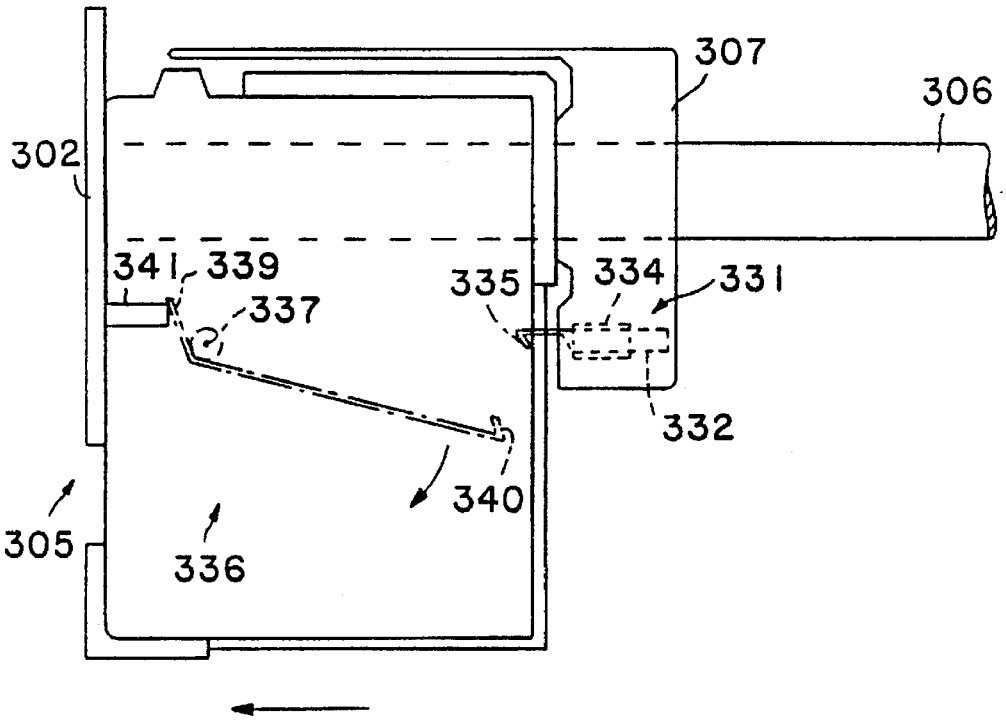
Figure 6C:
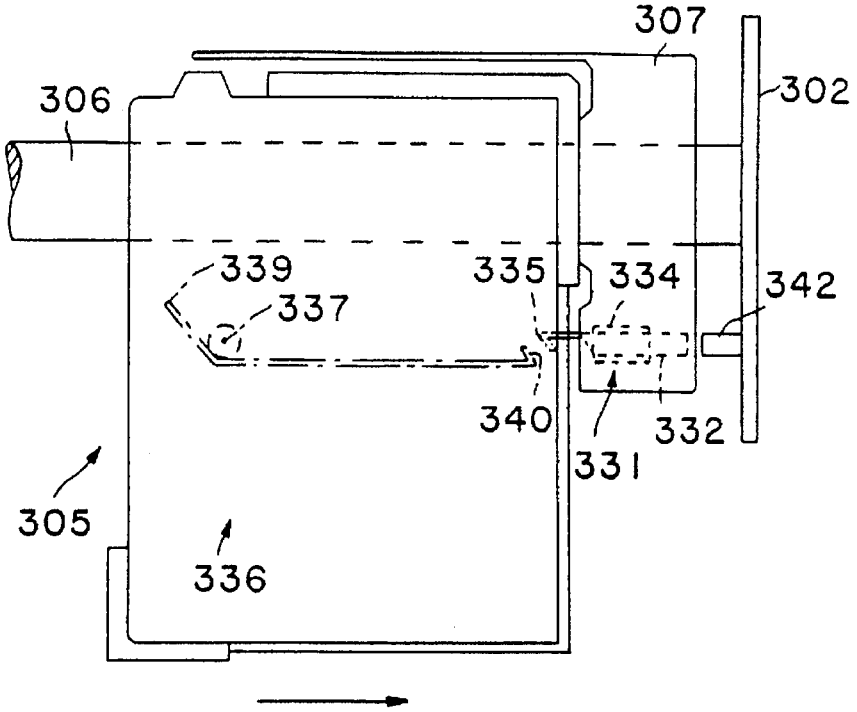

FIG. 6B also shows all these elements. FIGS. 6C through 6F show all the elements illustrated in FIG. 6A, except that instead of a left wall of the frame 302, a right wall of the frame 302 is shown with a coupling stud 342 extending therefrom. FIG. 6G shows all the elements shown in FIG. 6A, except for the frame 302 and the attached uncoupling stud 341.

The frame 302, the printing assembly 305, the guide rail 306, and the print position indicator 307 have the same structure and function as the frame 2, the printing assembly 5, the guide rail 6, and the print position indicator 7 shown in FIGS. 1A, 1B, 2A, and 2B, respectively, except that the printing assembly 305 and the print position indicator 307 are coupled to each other and uncoupled from each other in a different manner than the printing assembly 5 and the print position indicator 7 because the electromagnet 16 and the coupling element 20 have been replaced by the coupling elements 331 and 336.

The coupling element 331 is adapted to engage and disengage the coupling element 336. When engaging each other, the coupling elements 331 and 336 couple the print position indicator 307 to the printing assembly 305. Thus, the coupling elements 331 and 336 together comprise a coupling mechanism. Unlike the first embodiment of the coupling mechanism shown in FIGS. 2A, 2B, 3A, and 3B, the coupling mechanism in this embodiment is not directly actuated by the CPU 325. Rather, the coupling stud 341 and the uncoupling stud 342 couple and uncouple the coupling elements 331 and 336. However, in this embodiment the CPU 325 still controls the other functions of the printer.

The pin 332 of the coupling element 331 is adapted to slide in the housing 334. The end of the pin 332 comprises the hook 335 which is adapted to engage the hook 340 of the coupling element 336, as shown in FIG. 6A. Also provided is a spring (not shown) biasing the pin 332 to the right, into a retracted, non-coupling position, as shown in FIGS. 6B and 6C. The pin 332 is adapted to be pushed to the left against the bias of the spring by the coupling stud 342, as shown in FIGS. 6D, 6E, and 6F to a coupling position at which the hook 335 engages the hook 340, as will be discussed in more detail below.

The coupling element 336 is biased by the spring 337 against clockwise rotation. The end 339 of the coupling element 336 is adapted to abut the uncoupling stud 341 when the printing assembly 305 is moved to the home position, as shown in FIG. 6B. The spring 337 biases the coupling element 336 into a first position as shown in FIGS. 6A, 6C, 6F, and 6G. Depending on the position of the coupling element 331, in this first position the coupling element 336 will either be spaced from and disengaged from the coupling element 331, as seen in FIGS. 6C, or engaged with the coupling element 331, as shown in FIGS. 6A, 6F, and 6G. The coupling element 336 can be rotated by the uncoupling stud 341 against the bias of the spring 337 into a second position, shown in FIG. 6B, spaced from the first position, in which the coupling element 336 is disengaged from the coupling element 331.

[II. Operation]

[A. Using An Electromagnet]

Figure 7A:
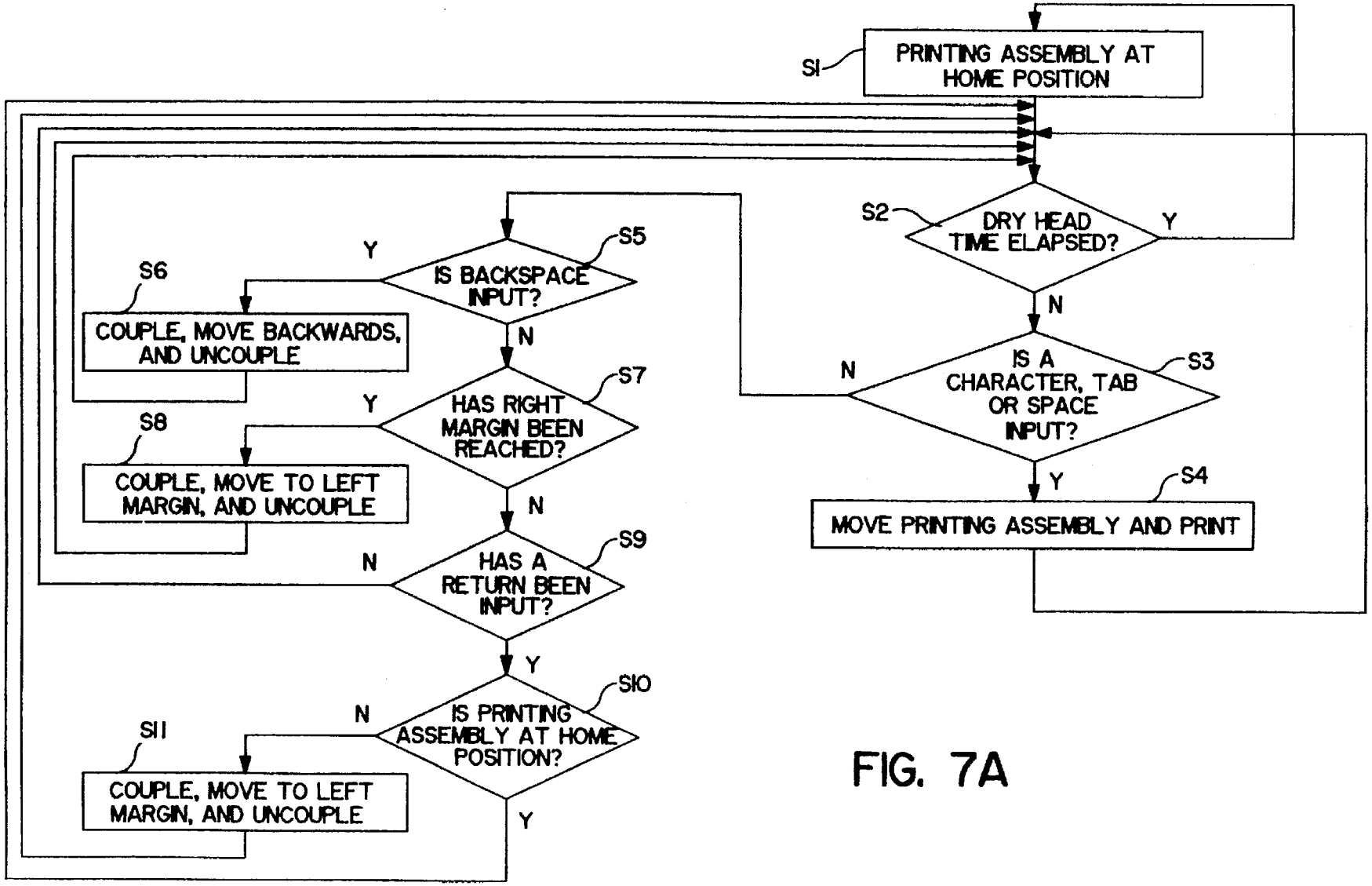
FIGS. 7A and 7B are flow charts illustrating two embodiments of a method of the present invention.

Operation of the mechanical position indicator shown in FIGS. 2A and 2B will now be explained with reference to the flow diagram of FIG. 7A.

When the printer 1 is turned on, the printing assembly 5 is at the home position and the print head 14 is capped by the print head capping mechanism 11, as seen in FIG. 1A. The print position indicator 7 abuts the right edge of the printing assembly 5, as seen in FIG. 2B, and is uncoupled from the printing assembly 5 because the CPU 25 has previously turned off the power to the electromagnet 16. This condition occurs in step S1 of FIG. 7A. The printer 1 is awaiting the input of characters, spaces, and tabs from the keyboard 4. In this embodiment, the printer 1 operates in the character-by-character mode.

From step S1, the method advances to step S2. In step S2 the CPU 25 determines whether a predetermined dry print head time has elapsed since the print head 14 has printed. This predetermined time is 5 or 10 seconds, depending on the model of the printer 1. The predetermined dry print head time is selected as the maximum time since the last printing operation before the print head 14 must return to the home position from any point along the guide rail 6, to be capped by the print head capping mechanism 11 before drying out. Of course, after the printer 1 is turned on, printing has likely not occurred for some time, and the printing assembly 5 is at the home position capped by the capping mechanism 11. Thus, there would not appear to be a need for step S2. However, a malfunction can occur, moving the printing assembly away from the home position. Without step S2, the print head 14 would dry out if printing does not occur within 5 or 10 seconds. Moreover, after the print head 14 prints, there is a need for the printer 1 to determine whether the predetermined dry print head time has elapsed. Otherwise, if the user pauses and the inputting of characters is stopped for 5 or 10 seconds after printing, the print head 14 may dry out. In order to address this problem, the method returns to step S2 after printing, as will be discussed below.

In step S2 if the CPU 25 determines that the predetermined dry print head time has elapsed, the CPU 25 maintains the print position indicator 7 uncoupled from the printing assembly 5 by maintaining the electromagnet 16 in an off state. In addition, the CPU 25 determines whether the printing assembly 5 is at the home position. If it is, the CPU 25 maintains the printing assembly 5 at the home position and maintains the capping of the print head 14 by the capping mechanism 11. If the CPU 25 determines that the printing assembly 5 is not at the home position, but is located at another position, the CPU 25 instructs the motor 29 to move the printing assembly 5 to the home position at which the print head 14 will be capped with the print head capping mechanism 11. When the printing assembly 5 then moves to the home position, it leaves the print position indicator 7 in place, still indicating the position at which the print head 14 would have printed had the print head 14 not moved to the home position. Such a separation of the printing assembly 5 from the print position indicator 7 is shown in FIGS. 1B and 2A. Thus, if the predetermined dry print head time is determined to have elapsed in step S2, the method returns to step S1 in which the printing assembly 5 is at the home position.

If the CPU 25 determines that the predetermined dry print head time has not elapsed in step S2, the method advances to step S3 where the CPU 25 determines whether a character, a tab, or a space is input from the keyboard 4. If the CPU 25 determines that a character, a tab, or a space is input into the printer 1, the method advances to step S4. In step S4, the CPU 25 instructs the motor 29 to move the print head carrier 12 and the print head 14 to the right from the home position to a first print position at a left margin. The sliding of the printing assembly 5 on the guide rail 6 to the right toward the first print position pushes the print position indicator 7 to the right along the guide rail 6.

The print position indicator 7 is configured so that when the printing assembly 5 is at a print position and the print position indicator 7 abuts the right edge of the printing assembly 5, the print position indicator 7 indicates the next print position. This is accomplished by the arm 19 pointing to the next print position whenever the coupling element 20 abuts the right edge of the print head carrier 12. Thus, as the printing assembly 5 pushes the print position indicator 7 to the right and approaches the first print position, the arm 19 points to the first print position.

When the printing assembly 5 reaches the first print position, the CPU 25 instructs the print head 14 to print an input character, if the first data input with the keyboard 4 was a character. Alternatively, if the first data input with the keyboard 4 was a space or a tab, the CPU 25 instructs the print head 14 to refrain from printing to leave a space when arriving at the first print position. Moving the printing assembly 5 to the right to the first print position pushes the print position indicator 7 to the right so that the print position indicator 7 indicates a second print position after the print head 14 prints the input character or leaves a space at the first print position. During this operation, the CPU 25 maintains the electromagnet 16 in an off state. As a result, the print position indicator 7 is maintained uncoupled from the printing assembly 5.

The method then returns to step S2. If, in step S2, the CPU 25 determines that the predetermined dry print head time has not elapsed, the method advances to step S3, where the CPU 25 determines whether a new character, tab, or space is input from the keyboard 4.

If the CPU 25 determines that a new character, space, or tab is input into the printer 1, the method advances to step S4. In step S4, the CPU 25 instructs the motor 29 to move the printing assembly 5 to the right to the second print position. At the second print position, the CPU 25 instructs the print head 14 to print the next input character input with the keyboard 4. This movement of the printing assembly 5 to the second print position pushes the print position indicator 7 to the right to indicate a third print position. The method then returns to step S2 to determine whether the predetermined dry print head time has elapsed, and if not, to await the input of a new character, a new space, or a new tab in step S3.

When a new character, a new space, or a new tab is input with the keyboard 4, the method advances to step S4, the CPU 25 instructs the motor 29 to move the printing assembly 5 to the third print position, and the print position indicator 7 then indicates a fourth print position. The moving of the printing assembly 5 and the print position indicator 7 to the right and the printing by the print head 14 in response to the inputting of new characters with the keyboard 4 continues until a sufficient number of characters, spaces, and tabs are input so that the printing assembly 5 reaches a right margin. When the CPU 25 determines that this occurs, in one embodiment the CPU 25 1) actuates the electromagnet 16 thereby attracting the coupling element 20 of the print position indicator 7 to the electromagnet 16 to couple the print position indicator 7 to the printing assembly 5, 2) instructs the motor 29 to return the printing assembly 5 to the left margin to the first print position, and 3) instructs the paper feeding mechanism to rotate the platen 10 a sufficient distance so that the print head 14 can then print on the next line of the paper. The process shown in FIG. 7A is then repeated for this next line and all subsequent lines of characters that are printed on the paper.

If the CPU 25 determines that a character, a space, or a tab is not input in step S3, the method advances to step S5. In step S5, the CPU 25 determines whether a backspace has been input into the printer 1 from the keyboard 4. If it has, the method advances to step S6. In step S6 the CPU 25 turns on the electromagnet 16, thereby coupling the print position indicator 7 to the printing assembly 5. The CPU 25 then instructs the motor 29 to move the printing assembly 5 backwards (to the left) to a backspace position. As a result, the printing assembly 5 moves backwards to the backspace position, thereby pulling the print position indicator 7 backwards. When this is accomplished, the CPU 25 turns off the electromagnet 16, thereby uncoupling the printing assembly 5 from the print position indicator 7. Then, the method returns to step S2.

If the CPU 25 determines in step S5 that a backspace has not been input, the method advances to step S7. In step S7, the CPU 25 determines whether the printing assembly 5 has reached the right margin. As noted above, the printing assembly 5 reaches the right margin in response to the inputting of a sufficient number of characters, spaces, and tabs by the keyboard 4. If the CPU 25 determines that the printing assembly 5 has reached the right margin, the method advances to step S8. In step S8, the CPU 25 turns on the electromagnet 16, thereby coupling the print position indicator 7 to the printing assembly 5. The CPU 25 then instructs the motor 29 to move the printing assembly 5 to the left to the left margin. As a result, the printing assembly 5 moves to the left margin, thereby pulling the print position indicator 7 to the left to be positioned adjacent to the left margin. When this is accomplished, the CPU 25 turns off the electromagnet 16, thereby uncoupling the printing assembly 5 from the print position indicator 7. Then, the method returns to step S2.

If the CPU 25 determines in step S7 that the printing assembly 5 has not reached the right margin, the method advances to step S9. In step S9, the CPU 25 determines whether a return has been input by the keyboard 4. If a return has not been input, the method returns to step S2. If a return has been input, the method advances to step S10. In step S10 the CPU 25 determines whether the printing assembly 5 is located at the home position. If the printing assembly 5 is at the home position, the method returns to step S2. If the CPU 25 determines that the printing assembly 5 is not at the home position, the method advances to step S11. In step S11, the CPU 25 turns on the electromagnet 16, thereby coupling the printing assembly 5 and the position indicator 7. In addition, the CPU 25 instructs the motor 29 to move the printing assembly 5 to the left margin. After the motor 29 has moved the printing assembly 5 to the left margin, the CPU 25 turns off the electromagnet 16 to uncouple the printing assembly 5 and the position indicator 7. The method then returns to step S2.

The operation of the optical position indicator shown in FIGS. 3A and 3B will now be explained.

Here, unlike the embodiment shown in FIGS. 2A and 2B, in which the printer operates in the character-by-character mode, when the position indicator 107 comprises the light source 121 shown in FIGS. 3A and 3B, the printer operates in the queue mode. In this mode, during the inputting of characters and spaces, the CPU 125 instructs the motor 129 to keep the printing assembly 105 stationary at the home position where it is capped, until the number of input characters and spaces is greater than a predetermined number of print positions at which characters of a given font size (chosen by the CPU 125) will be printed that can be indicated by the light source 121. While the characters and spaces are being input, the CPU 125 instructs the sequential illumination of the light emitting diodes 122 so that the predetermined number of print positions are illuminated sequentially. Once the number of input characters and spaces is greater than the predetermined number of print positions, the CPU 125 instructs the motor 129 to move the printing assembly 105 to the first and subsequent print positions and instructs the print head 114 to sequentially print the input characters in the order in which these characters are input by the keyboard 104. Once it has moved to this predetermined number of print positions and printed, the printing assembly 105 then returns to the home position to cap the print head 114 with the print head capping mechanism 111 and awaits the inputting of additional characters and spaces whose corresponding print positions are sequentially illuminated by the light emitting diodes 122 while the printing assembly 105 remains at the home position.

Alternatively, in another embodiment, once it has moved to this predetermined number of print positions and printed, the printing assembly 105 remains at the last print position while awaiting the inputting of additional characters and spaces whose corresponding positions are sequentially illuminated by the light emitting diodes 122. In this embodiment, the CPU 125 can set a spell verify mode in response to the depressing of a spell verify key by the operator. In the spell verify mode, the CPU 125 maintains the print head 114 at the last print position without printing and sequentially illuminates the light emitting diodes 122 to sequentially indicate the next print positions while the operator inputs the letters of the next word. The CPU 125 also verifies the spelling of this word when it determines that the word is completely input. If the word is correctly spelled, it is then printed. Of course, if the CPU 125 determines that the print head 114 remains at the last print position longer than the predetermined dry print head time, the CPU 125 ensures that the printing assembly 105 and the print position indicator 107 are uncoupled and instructs the motor 129 to move the printing assembly 105 to the home position at which the print head 114 is capped. This moving of the printing assembly 105 to the home position does not affect the sequential illuminating of the light emitting diodes 122 as the additional characters and spaces are input by the keyboard 104.

In this embodiment, the CPU 125 selects the font of the characters to be printed, either in response to the user inputting this information with the keyboard 104, or on its own. If the CPU 125 selects font # 1 shown in FIG. 5A, for example, it instructs the counter 130 and its associated circuitry, in the embodiment shown in FIG. 4B, to illuminate the two light emitting diodes 122 closest to the next print position, to visually indicate the next print position. Alternatively, in the embodiment shown in FIG. 4C, the CPU 225 instructs the light emitting diodes 222 directly to illuminate the two light emitting diodes 222 closest to the next print position to visually indicate the next print position. If the CPU 125 selects font # 2 shown in FIG. 5B, it instructs the illumination of the three light emitting diodes closest to the next print position to visually indicate the next print position. Thus, more generally, the CPU 125 instructs the illumination of a predetermined number of light emitting elements 122 to indicate a next print position, the predetermined number of light emitting elements being determined by the CPU 125 in accordance with the size of the font of the character input by the keyboard 104 to be printed at the indicated print position.

Thus, when the light emitting diodes # 1 and π 2 shown in FIG. 5A are desired to be illuminated to visually indicate the first print position at which the letter "a" will be printed in font π 1, the CPU 125 sends the appropriate signal to the counter 130 so that the counter 130 is incremented and its associated circuitry illuminates diodes π 1 and π 2. Alternatively, in the embodiment without a counter shown in FIG. 4C, the CPU 225 sends the appropriate signal directly to diodes π 1 and π 2. When a second print position at which the letter "b" in font π 1 is to be printed is then desired to be illuminated, additional signals are sent from the CPU 125 to increment the counter 130 so that the counter 130 and its associated circuitry extinguishes light emitting diodes π 1 and π 2 and illuminates light emitting diodes π 3 and #4. Or, in the embodiment shown in FIG. 4C, the CPU 225 directly turns off diodes π 1 and π 2 and illuminates diodes π 3 and π 4. This process continues until all the next print positions of which the position indicator 107 is capable of indicating without moving are illuminated sequentially.

When the printer is turned on, the printing assembly 105 is at the home position and the print head 114 is capped by the print head capping mechanism 111. The print position indicator 107 abuts the right edge of the printing assembly 105, as seen in FIG. 3B, and is uncoupled from the printing assembly 105 because the CPU 125 has previously turned off the power to the electromagnet 116. This condition is shown in step S1 of FIG. 7A.

From step S1, the method advances to step S2. In step S2 the CPU 125 determines whether a predetermined dry print head time has elapsed since the print head 114 has printed. This predetermined time is 5 or 10 seconds, depending on the model of the printer 1. The predetermined dry print head time is selected to provide sufficient time after the last printing operation for the print head 114 to return to the home position from any point along the guide rail 106, to be capped by the print head capping mechanism 111 before drying out. Of course, after the printer is turned on, printing has likely not occurred for some time, and the printing assembly 105 is at the home position capped by the capping mechanism 111. Thus, there would not appear to be a need for step S2. Mowever, a malfunction can occur, moving the printing assembly away from the home position. Without step S2, the print head 114 would dry out if printing does not occur within 5 or 10 seconds. Moreover, after the print head 114 prints, there is a need for the printer to determine whether the predetermined dry print head time has elapsed. Otherwise, if the user pauses and the inputting of characters is stopped for 5 or 10 seconds after printing, the print head 114 may dry out. In order to address this problem, the method returns to step S2 after printing, as will be discussed below.

In step S2 if the CPU 125 determines that the predetermined dry print head time has elapsed, the CPU 125 maintains the print position indicator 107 uncoupled from the printing assembly 105 by maintaining the electromagnet 116 in an off state. In addition, the CPU 125 determines whether the printing assembly 105 is at the home position. If it is, the CPU 125 maintains the printing assembly 105 at the home position and maintains the capping of the print head 114 by the capping mechanism 111. If the CPU 125 determines that the printing assembly 105 is not at the home position, but is located at another position, the CPU 125 activates the print head capping mechanism 111 and instructs the motor 129 to move the printing assembly 105 to the home position at which the print head 114 will be capped with the print head capping mechanism 111. When the printing assembly 105 then moves to the home position, it leaves the print position indicator 107 in place, still indicating the position at which the print head 114 would have printed had the print head 114 not moved to the home position. Such a separation of the printing assembly 105 from the print position indicator 107 is shown in FIG. 3A. Thus, if the predetermined dry print head time is determined to have elapsed in step S2, the method returns to step S1 in which the printing assembly 105 is at the home position.

In step S2, after determining whether the predetermined dry print head time has elapsed, the CPU 125 then instructs the motor 129 to move the printing assembly 105 toward the left margin, thereby pushing the print position indicator 107 to the left margin. The left margin is the first position at which a character can be printed. Thus, the print position indicator 107 can indicate this first print position. The CPU 125 then instructs the motor 129 to move the printing assembly 105 back to the home position. Alternatively, the CPU 125 can turn the motor 129 off and maintain the printing assembly 105 at the left margin, ready to print. The printer then awaits the input of characters, spaces, and tabs from the keyboard 104 in step S3.

Figure 8:
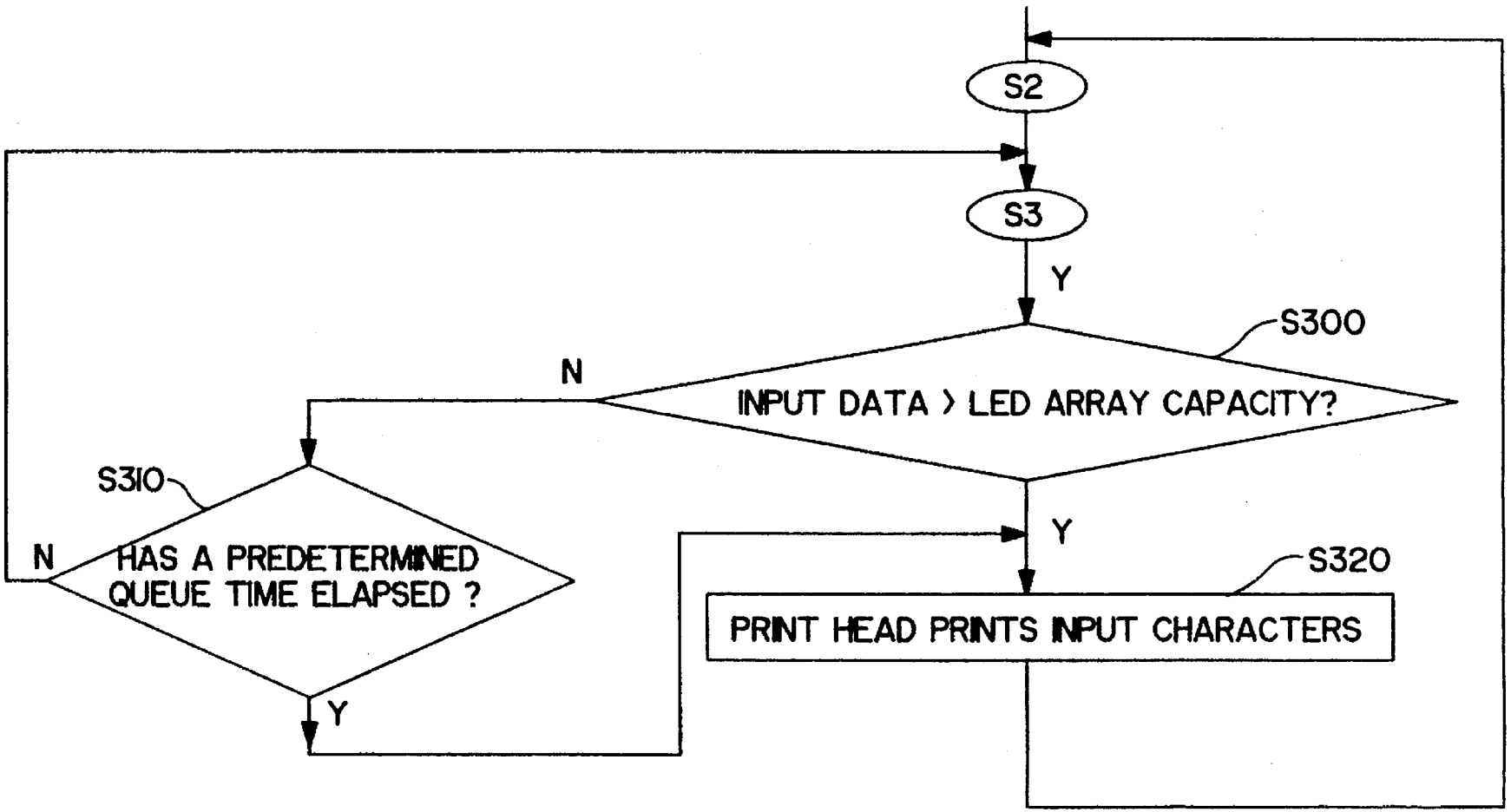
FIG. 8 is a flow chart illustrating an alternative embodiment for step S3 shown in FIG. 7A.

If the CPU 125 determines in step S2 that the predetermined dry print head time has not elapsed, the method also advances to step S3 where the CPU 125 determines whether a character, a tab, or a space is input from the keyboard 104. If the CPU 25 determines that a character, a tab, or a space is input into the printer, the method advances to step S4, the details of which are shown in FIG. 8. When the CPU 125 determines that a character, a tab, or a space is input, the method advances to step S300, shown in FIG. 8. In this step the CPU 125 maintains the printing assembly 105 at the home position (or in an alternative embodiment maintains the printing assembly 105 at the first print position at the left margin) and illuminates a predetermined number of light emitting diodes 122 closest to the first print position, thereby visually indicating the first print position. The CPU 125 also determines whether the number of input characters and spaces is greater than the number of positions that can be indicated by the light emitting diodes 122 when the print position indicator 107 is stationary. If the number of input characters and spaces is not greater than the number of positions that can be indicated by the light source 121, the CPU 125 then determines whether a predetermined queue time has elapsed since the print head has printed in step S310. The predetermined queue time is programmable by the user via the keyboard 104. If the queue time has elapsed, the method advances to step S320 where the print head 114 prints the input characters, as will be discussed in more detail below. Thus, if the user inputs fewer characters than the number of positions capable of being indicated by the light source 121 and pauses, the print head 114 will eventually print the input characters.

If the predetermined queue time has not elapsed, the method returns to step S3. In step S3 the CPU 125 again determines whether a character, a tab, or a space is input from the keyboard 104. If the CPU 125 determines that such data is input into the printer, the method again advances to step S300. The CPU 125 continues to maintain the printing assembly 105 at the home position (or in the alternative embodiment at the first print position) and illuminates a predetermined number of light emitting diodes 122 closest to the second position at which a character will be printed, thereby visually indicating the second print position. This process continues, with the CPU 125 maintaining the printing assembly 105 at the home position (or in the alternative embodiment at the first print position) and sequentially illuminating light emitting diodes 122 closest to successive print positions until the CPU 125 determines that the number of input characters and spaces is greater than the number of positions that can be indicated by the light emitting diodes 122. When this occurs, the method advances to step S320. In addition, in step S310, if the predetermined queue time has elapsed since the print head 114 has printed, the method also advances to step S320.

In step S320, the CPU 125 instructs the motor 129 to move the printing assembly 105 to the right and instructs the print head 114 to print the unprinted inputted characters. This movement of the printing assembly 105 to the right pushes the print position indicator 107 to the right to indicate the next print positions. Thus, for example, if the diodes 122 can illuminate four print positions for a selected font size, and the print head 114 has just printed at these four positions, the print position indicator 107 is now ready to illuminate the fifth, the sixth, the seventh, and the eighth print positions, as new characters and spaces are input with the keyboard 104.

During these operations, the CPU 125 maintains the electromagnet 116 in an off state. As a result, the print position indicator 107 is maintained uncoupled from the printing assembly 105.

From step S320, the method returns to step S2. The method then advances to steps S3 and S4 again and the process shown in FIG. 8 is repeated for each input character, with the printing assembly 105 moving to the right and printing, and pushing the print position indicator 107 to the right each time the number of input characters and spaces is greater than the number of positions that can be indicated by the light emitting diodes 122. The moving of the printing assembly 105 and the print position indicator 107 to the right in response to the inputting of new characters, spaces, and tabs with the keyboard 104 continues until a sufficient number of characters, spaces, and tabs are input so that the printing assembly 105 reaches the right margin. When this occurs, the CPU 125 actuates the electromagnet 116. As a result, the coupling element 120 of the print position indicator 107 is attracted to the electromagnet 116, thereby coupling the print position indicator 107 to the printing assembly 105. The CPU 125 then instructs the motor 129 to return the printing assembly 105 to the left margin in one embodiment or, in another embodiment, to the home position where the print head 114 is capped by the print head capping mechanism 111. The CPU 125 also instructs the paper feeding mechanism to rotate the platen a sufficient distance, so that the print head 114 can then print on the next line of the paper. The process outlined in FIGS. 7A and 8 is then repeated for this next line and all subsequent lines on the paper.

If the CPU 125 determines that a character, a tab, or a space is not input in step S3, the method advances to step S5. In step S5, the CPU 125 determines whether a backspace has been input into the printer from the keyboard 104. If it has, the CPU 125 determines whether the printing assembly 105 is located at the home position. If not, the method advances to step S6. If the printing assembly 105 is located at the home position, the CPU 125 instructs the motor 129 to move the printing assembly 105 so that the right edge of the printing assembly 105 is adjacent the print position indicator 107 and the method advances to step S6. In step S6 the CPU 125 turns on the electromagnet 116, thereby coupling the print position indicator 107 to the printing assembly 105. The CPU 125 then instructs the motor 129 to move the printing assembly 105 backwards to a backspace position. As a result, the printing assembly 105 moves to the left to the backspace position, thereby pulling the print position indicator 107 to the left. Thus, the position indicator 107 is now able to indicate a predetermined number of positions to the right of the backspace position. When this is accomplished, the CPU 125 turns off the electromagnet 116, thereby uncoupling the printing assembly 105 from the position indicator 107. Then, the method returns to step S2.

If the CPU 125 determines in step S5 that a backspace has not been input, the method advances to step S7. In step S7, the CPU 125 determines whether a sufficient number of characters and spaces has been input so that the printing assembly 105 reaches the right margin or so as to indicate and print one line of characters all the way to the right margin. If so, the CPU 125 determines whether the printing assembly 105 is located at the home position. If not, the method advances to step S8. If the printing assembly 105 is located at the home position, the CPU 125 instructs the motor 129 to move the printing assembly 105 so that the right edge of the printing assembly 105 is adjacent the position indicator 107 and the method advances to step S8. In step S8, the CPU 125 turns on the electromagnet 116, thereby coupling the print position indicator 107 to the printing assembly 105. The CPU 125 then instructs the motor 129 to move the printing assembly 105 to the left to the left margin. As a result, the printing assembly 105 moves to the left margin, thereby pulling the print position indicator 107 to the left to be positioned adjacent to the left margin. When this is accomplished, the CPU 125 turns off the electromagnet 116, thereby uncoupling the printing assembly 105 from the print position indicator 107. Then, the method returns to step S2.

If the CPU 125 determines in step S7 that the printing assembly 105 has not reached the right margin, the method advances to step S9. In step S9, the CPU 125 determines whether a return has been input by the keyboard 104. If a return has not been input, the method returns to step S2. If a return has been input, the method advances to step S10. In step S10 the CPU 125 determines whether the printing assembly 105 is located at the home position. If the printing assembly 105 is at the home position, the method returns to step S2. If the CPU 125 determines that the printing assembly 105 is not at the home position, the method advances to step S11. In step S11, the CPU 125 turns on the electromagnet 116, thereby coupling the printing assembly 105 and the position indicator 107. In addition, the CPU 125 instructs the motor 129 to move the printing assembly 105 to the left margin. After the motor 129 has moved the printing assembly 105 to the left margin, the CPU 125 turns off the electromagnet 116 to uncouple the printing assembly 105 and the position indicator 107. The method then returns to step S2.

[B. Using Mechanical Coupling Elements]

In the embodiment shown in FIGS. 2A and 2B, by using the electromagnet 20 to couple the printing assembly 5 to the print position indicator 7, these two devices can be coupled at any point along the guide rail 6. Such coupling requires instructions from the CPU 25 to turn on the electromagnet 16. The embodiment shown in FIGS. 4D and 6A–6G, on the other hand, does not require the CPU 325 to turn on an electromagnet to couple the print position indicator 307 to the printing assembly 305. Rather, coupling is accomplished by pushing the coupling element 331 against the coupling stud 342, and uncoupling is accomplished by pushing the coupling element 336 against the uncoupling stud 341. However, unlike the embodiment using the electromagnet, coupling and uncoupling cannot be performed at any point along the guide rail 306. Instead, coupling must be performed at the farthest right position of the print position indicator 307 because the coupling stud 342 is located on the right wall of the frame 302. Moreover, because the uncoupling stud 341 is located on the left wall of the frame 302, uncoupling must be performed at the farthest left position of the print head carrier 316, i.e. the home position. The precise manner in which this coupling and uncoupling is performed is illustrated in FIGS. 6A–6G and in FIG. 7B.

FIG. 6A shows the coupling element 331 engaging the coupling element 336, thereby coupling the printing assembly 305 to the print position indicator 307, as the motor 329 moves the printing assembly 305 to the left toward the home position and the uncoupling stud 341, as shown by the leftward pointing arrow. Such leftward movement occurs in response to 1) the inputting of a return into the printer with the keyboard 304, 2) the reaching of the right margin by the print head 314, or 3) the CPU 325 determining that a dry print head time has elapsed and instructing the motor 329 to move the print head 314 to the home position. As a result, the printing assembly 305 pulls the print position indicator 307 to the left.

In FIG. 6B the printing assembly 305 has reached the uncoupling stud 341. When this occurs, the uncoupling stud 341 contacts the end 339 of the coupling element 336, rotating the coupling element 336 clockwise, from a first position in which the hook 340 of the coupling element 336 engaged the hook 335 of the coupling element 331, to a second position out of engagement therewith. This rotation occurs against the bias of the spring 337. As soon as the coupling element 336 disengages the coupling element 331, the spring of coupling element 331 causes the pin 332 to retract from its coupling position to an uncoupling position shown in FIG. 6B. Thus, the uncoupling stud 341 is configured and positioned so as to cause the hook 340 to disengage the hook 335 when the print head 314 reaches the home position.

At this time, the print head 314 is now ready to print new characters on a sheet of paper placed in the printer. Printing can be performed either in the character-by-character mode using the position indicator 307 having the shape of the position indicator 7 shown in FIGS. 2A and 2B, or in a queue mode using the light source 121 shown in FIGS. 3A and 3B as the position indicator.

Whichever mode is set, the printing assembly 305 eventually moves to the right, pushing the print position indicator 307 to the right. This movement is signified by the rightward pointing arrow seen in FIG. 6C. As seen in this figure, the printing assembly 305 is now approaching the right margin and the right wall of the frame 302. As a result, a sufficient number of characters or spaces have already been input into the printer so that the printing assembly 305 and the print position indicator 307, uncoupled from each other, approach the right margin and the coupling stud 342. Alternatively, the printing assembly 305 will approach the coupling stud 342 in response to the inputting of a return by the keyboard 304.

In order for the coupling stud 342 to cause engagement of the coupling elements 331 and 336, the printing assembly 305 and the print position indicator 307 must be moved to their farthest right positions. Thus, when the printing assembly 305 moves to the right margin due to the inputting of a sufficient number of characters and spaces, if the CPU 325 determines that the right margin is not the farthest right position of the printing assembly 305, the CPU 325 moves the printing assembly 305 further to the right to its farthest right position, so that the coupling stud 342 engages coupling element 331, as will be discussed in more detail below. Moreover, when a return is input by the keyboard 304, the CPU 325 also instructs the motor 329 to move the printing assembly 305 further to the right to its farthest right position, so that the coupling stud 342 engages the coupling element 331.

Figure 6D:
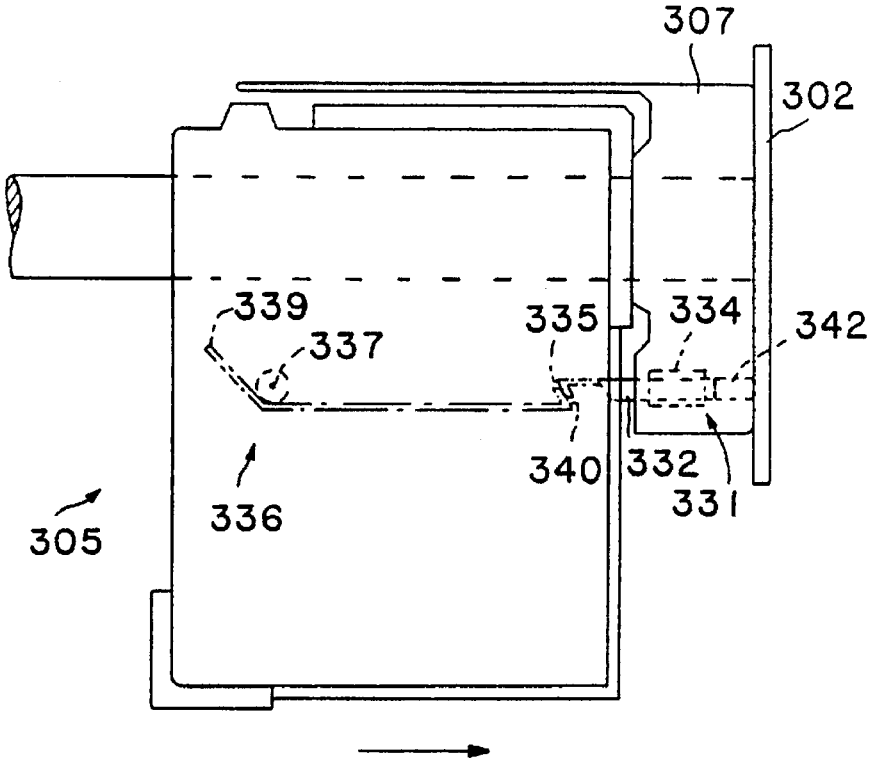
Figure 6E:
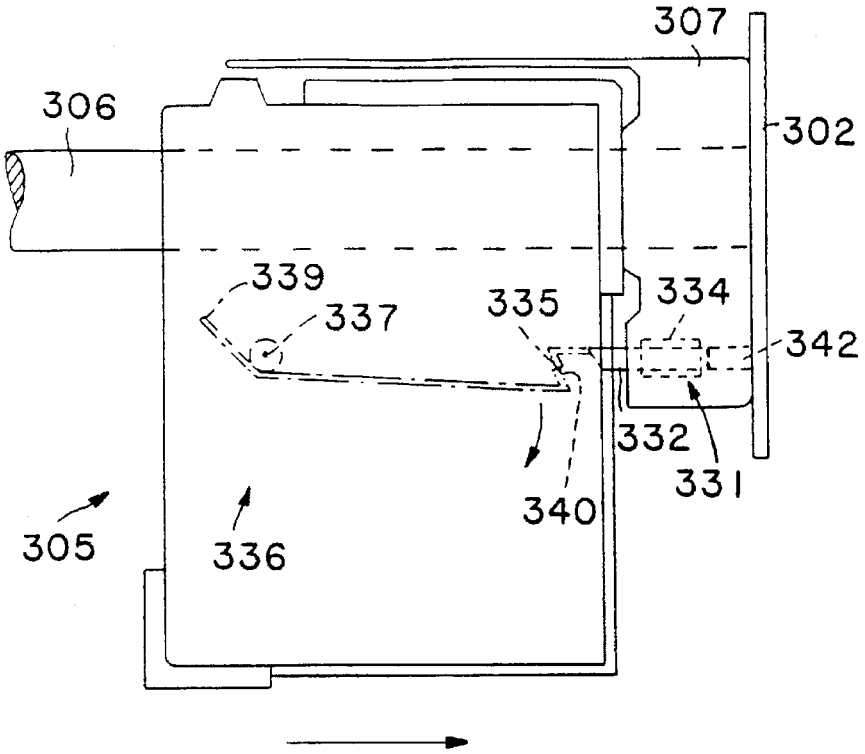
Figure 6F:
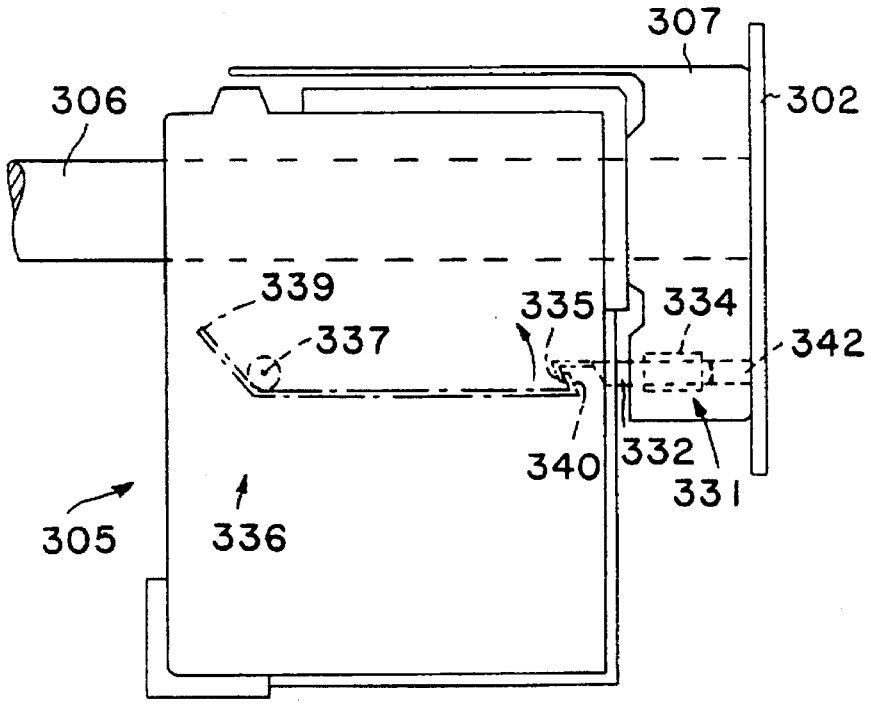
Figure 6G:
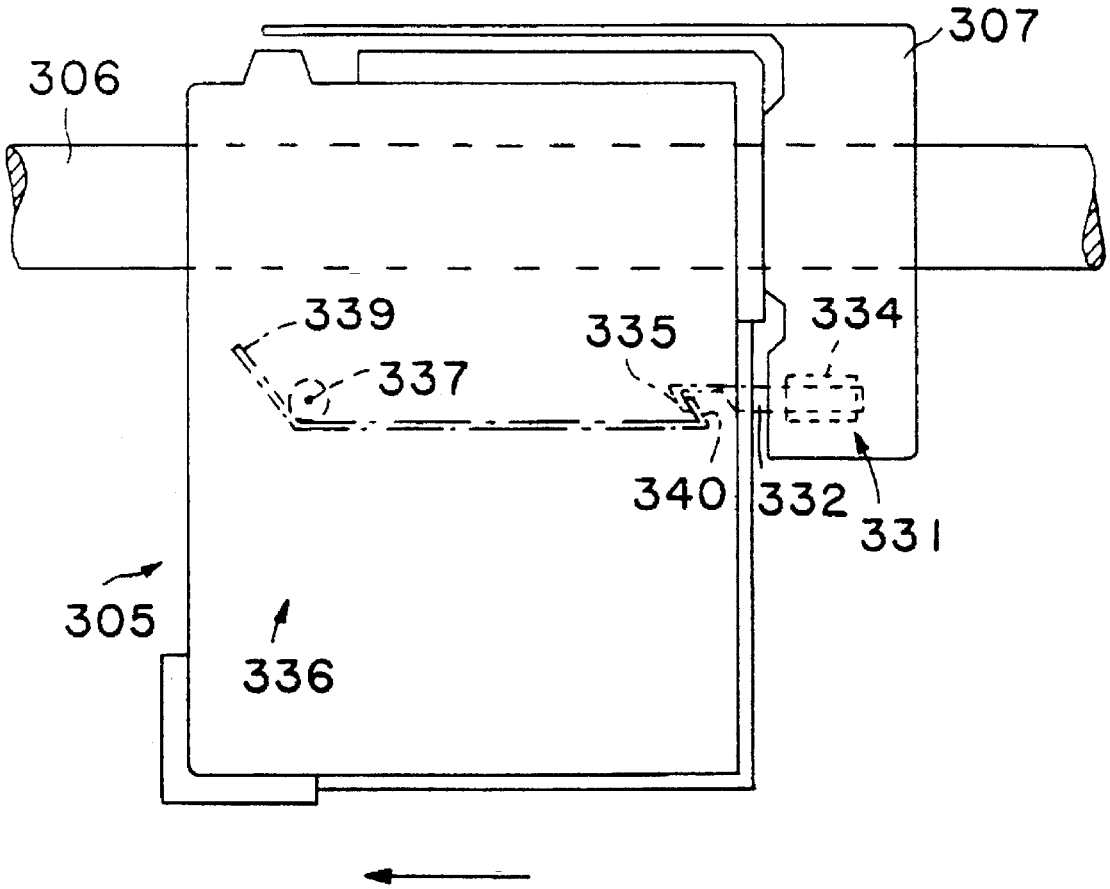

As the printing assembly 305 moves toward the coupling stud 342, shown by the rightward pointing arrow in FIG. 6D, the right end of the pin 332 of the coupling element 331 of the print position indicator 307 starts to press and push against the coupling stud 342. As a result, the pin 332 is pushed to the left against the bias of the spring of the coupling element 331, away from the uncoupling position of the coupling element 331. This, in turn, pushes the end of the hook 335 against the end of the hook 340. As the printing assembly 305 moves further to the right as instructed by the CPU 325, the coupling stud 342 pushes the hook 335 further to the left, rotating the hook 340 downward, away from the first position of the coupling element 336, against the bias of the spring 337, as shown in FIG. 6E. When the printing assembly 305 finally reaches its farthest right position, as seen in FIG. 6F, the coupling stud 342 pushes the end of the hook 335 further to the left, beyond the rightmost edge of the hook 340, to the coupling position of the coupling element 331. When this occurs, the hook 340 rotates upward to return to its first position. In addition, the spring of the coupling element 331 causes the hook 335 to retract slightly, thereby locking the hook 335 and the hook 340 into engagement with each other. Thus, the coupling stud 342 is configured and positioned to cause the hook 335 to engage the hook 340 when the printing assembly 305 reaches its farthest right position.

In response to the engaging of the coupling elements 331 and 336, the CPU 325 instructs the motor 329 to move the printing assembly 305 to the left to the home position. As a result, the printing assembly 305 and the print position indicator 307 coupled thereto, move to the left, as shown by the leftward pointing arrow in FIG. 6G.

Figure 7B:
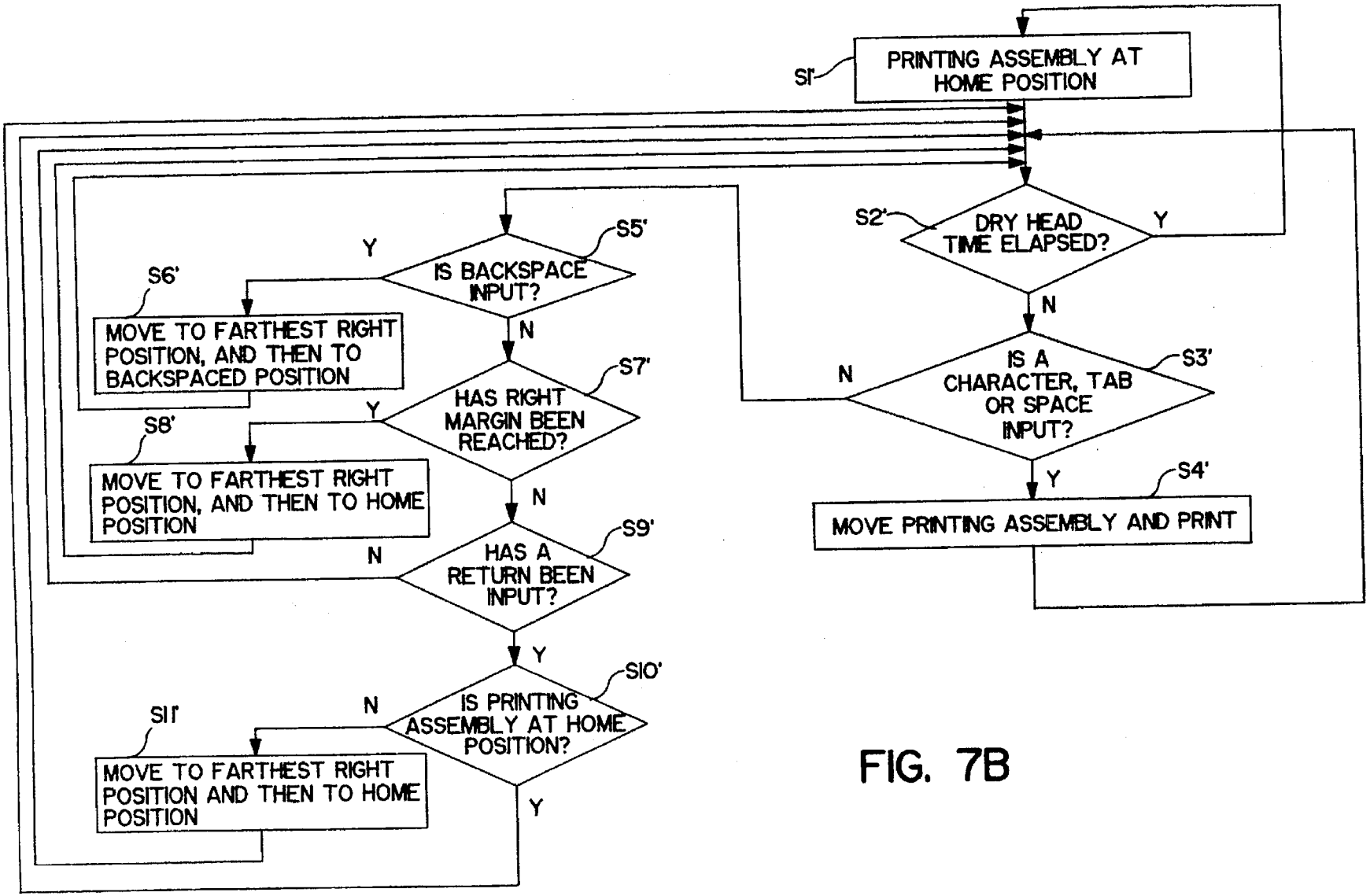

Turning to FIG. 7B, the method illustrated in these figures uses the print position indicator 307 which is configured in the shape of the print position indicator 7 shown in FIGS. 2A and 2B, and the printer operates in the character-by-character mode. In step S1', when the printer is turned on, the printing assembly 305 is at the home position, the position indicator 307 abuts the right edge of the printing assembly 305, and the print head 314 is capped. In this position, the uncoupling stud 341 has previously uncoupled the print position indicator 307 from the printing assembly 305, as discussed above. Moreover, the printer is awaiting the input of characters, spaces, and tabs from the keyboard 304.

From step S1', the method advances to step S2'. In step S2' the CPU 325 determines whether a predetermined dry print head time has elapsed since the print head 314 has printed. This predetermined time is 5 or 10 seconds, depending on the model of the printer. The predetermined dry print head time is selected to provide sufficient time after the last printing operation for the print head 314 to return to the home position from any point along the guide rail 306, to be capped by the print head capping mechanism 311 before drying out. Of course, after the printer is turned on, printing has likely not occurred for some time, and the printing assembly 305 is at the home position capped by the capping mechanism 311. Thus, there would not appear to be a need for step S2'. However, a malfunction can occur, moving the printing assembly 305 away from the home position. Without step S2', the print head 314 would dry out if printing does not occur within 5 or 10 seconds. Moreover, after the print head 314 prints, there is a need for the printer to determine whether the predetermined dry print head time has elapsed. Otherwise, if the user pauses and the inputting of characters is stopped for more than 5 or 10 seconds after printing, the print head 314 may dry out. In order to address this problem, the method returns to step S2' after printing, as will be discussed below.

In step S2' if the CPU 325 determines that the predetermined dry print head time has elapsed, the CPU 325 maintains the print position indicator 307 uncoupled from the printing assembly 305 by refraining from moving the printing assembly 305 to the coupling stud 342. In addition, the CPU 325 determines whether the printing assembly 305 is at the home position. If it is, the CPU 325 maintains the printing assembly 305 at the home position and maintains the capping of the print head 314 by the capping mechanism 311. If the CPU 325 determines that the printing assembly 305 is not at the home position, but is located at another position, the CPU 325 activates the print head capping mechanism 311 and instructs the motor 329 to move the printing assembly 305 to the home position at which the print head 314 will be capped with the print head capping mechanism 311. When the printing assembly 305 then moves to the home position, it leaves the print position indicator 307 in place, still indicating the position at which the print head 314 would have printed had the print head 314 not moved to the home position. Thus, if the predetermined dry print head time is determined to have elapsed in step S2', the method returns to step S1 in which the printing assembly 305 is at the home position.

If the CPU 325 determines that the predetermined dry print head time has not elapsed in step S2', the method advances to step S3' where the CPU 325 determines whether a character, a tab, or a space is input from the keyboard 304. If the CPU 325 determines that a character, a tab, or a space is input into the printer, the method advances to step S4'. In step S4', the CPU 325 instructs the motor 329 to move the print head carrier 312 and the print head 314 to the right from the home position to a first print position at a left margin. The sliding of the printing assembly 305 on the guide rail 306 to the right toward the first print position pushes the print position indicator 307 to the right along the guide rail 306.

The print position indicator 307 is configured so that when the printing assembly 305 is at a print position and the print position indicator 307 abuts the right edge of the printing assembly 305, the print position indicator 307 indicates the next print position. This is accomplished by the arm of the print position indicator 307 pointing to the next print position whenever the left edge of the print position indicator 307 abuts the right edge of the print head carrier 312. Thus, as the printing assembly 305 pushes the print position indicator 307 to the right and approaches the first print position, the arm of the print position indicator 307 points to the first print position.

When the printing assembly 305 reaches the first print position, the CPU 325 instructs the print head 314 to print an input character, if the first data input with the keyboard 304 was a character. Alternatively, if the first data input with the keyboard 304 was a space or a tab, the CPU 325 instructs the print head 314 to refrain from printing to leave a space when arriving at the first print position. Moving the printing assembly 305 to the right to the first print position pushes the print position indicator 307 to the right so that the print position indicator 307 indicates a second print position after the print head 314 prints the input character or leaves a space at the first print position. During this operation, the print position indicator 307 and the printing assembly 305 are maintained in the uncoupled state because they have not contacted the coupling stud 342.

The method then returns to step S2'. If, in step S2', the CPU 325 determines that the predetermined dry print head time has not elapsed, the method advances to step S3', where the CPU 325 determines whether a new character, tab, or space is input from the keyboard 304.

If the CPU 325 determines that a new character, space, or tab is input into the printer 1, the method advances to step S4'. In step S4', the CPU 325 instructs the motor 329 to move the printing assembly 305 to the right to the second print position. At the second print position, the CPU 325 instructs the print head 314 to print the next input character input with the keyboard 304. This movement of the printing assembly 305 to the second print position pushes the print position indicator 307 to the right to indicate a third print position. The method then returns to step S2' to determine whether the predetermined dry print head time has elapsed, and if not, to await the input of a new character, a new space, or a new tab in step S3'.

When a new character, a new space, or a new tab is input with the keyboard 304, the method advances to step S4', the CPU 325 instructs the motor 329 to move the printing assembly 305 to the third print position, and the print position indicator 307 then indicates a fourth print position. The moving of the printing assembly 305 and the print position indicator 307 to the right and the printing by the print head 314 in response to the inputting of new characters with the keyboard 304 continues until a sufficient number of characters, spaces, and tabs are input so that the printing assembly 305 reaches a right margin. When the CPU 325 determines that this occurs, in one embodiment the CPU 325 1) actuates the motor 329 to move the printing assembly 305 to the coupling stud 342 to couple the print position indicator 307 to the printing assembly 305, 2) instructs the motor 329 to return the printing assembly 305 to the left margin to the first print position, and 3) instructs the paper feeding mechanism to rotate the platen a sufficient distance so that the print head 314 can then print on the next line of the paper. The process shown in FIG. 7B is then repeated for this next line and all subsequent lines of characters that are printed on the paper.

If the CPU 325 determines that a character, a space, or a tab is not input in step S3', the method advances to step S5'. In step S5', the CPU 325 determines whether a backspace has been input into the printer from the keyboard 304. If it has, the method advances to step S6'. In step S6' the CPU 325 instructs the motor 329 to move the printing assembly 305 to its farthest right position at which the coupling stud 342 couples the print position indicator 307 to the printing assembly 305. The CPU 325 then instructs the motor 329 to move the printing assembly 305 backwards (to the left) to the backspace position, pushing the print position indicator 307 to the right to be adjacent the backspace position. Then, the method returns to step S2'.

If the CPU 325 determines in step S5' that a backspace has not been input, the method advances to step S7'. In step S7', the CPU 325 determines whether the printing assembly 305 has reached the right margin. As noted above, the printing assembly 305 reaches the right margin in response to the inputting of a sufficient number of characters, spaces, and tabs by the keyboard 304. If the CPU 325 determines that the printing assembly 305 has reached the right margin, the method advances to step S8'. In step S8', the CPU 325 activates the motor 329 to move the printing assembly 305 to its farthest right position so that the coupling stud 342 couples the printing assembly 307 to the print position indicator 307. The CPU 325 then instructs the motor 329 to move the printing assembly 305 to the home position at which the uncoupling stud 341 uncouples the printing assembly 305 from the print position indicator 307. Then the CPU 325 instructs the motor 329 to move the printing assembly 305 to the beginning of the left margin, thereby pushing the print position indicator 307 to indicate the print position at the left margin. Then, the method returns to step S2'.

If the CPU 325 determines in step S7' that the printing assembly 305 has not reached the right margin, the method advances to step S9'. In step S9', the CPU 325 determines whether a return has been input by the keyboard 304. If a return has not been input, the method returns to step S2'. If a return has been input, the method advances to step S10'. In step S10' the CPU 325 determines whether the printing assembly 305 is located at the home position. If the printing assembly 305 is at the home position, the method returns to step S2'. If the CPU 325 determines that the printing assembly 305 is not at the home position, the method advances to step S11'. In step S11', the CPU 325 instructs the motor 329 to move the printing assembly 305 to its farthest right position so that the coupling stud 342 couples the printing assembly 305 to the print position indicator 307. The CPU 325 then instructs the motor to move the printing assembly 305 to the home position at which the uncoupling stud 341 uncouples the printing assembly 305 and the print position indicator 307. In addition, the CPU 325 then instructs the motor 329 to move the printing assembly 305 to the left margin. The method then returns to step S2.

[C. The Line-By-Line Printing Mode]

In addition to printing in the character-by-character mode and in the queue mode, the present invention can also operate in a line-by-line mode. In this mode, characters are not printed until the right margin is reached by the printing assembly or a return is entered. This mode is most easily used with the embodiment of the print position indicator shown in FIGS. 2A and 2B and the printer shown in FIG. 4A, although the program stored in ROM 126 could be modified so that the embodiment shown in FIGS. 3A, 3B, and 4B can be used in this mode. For the purposes of the discussion below, the embodiment shown in FIGS. 2A, 2B, and 4A is used when the printer operates in the line-by-line mode. In addition, the line-by-line mode will be explained with reference to the flow diagram shown in FIG. 9.

Figure 9:
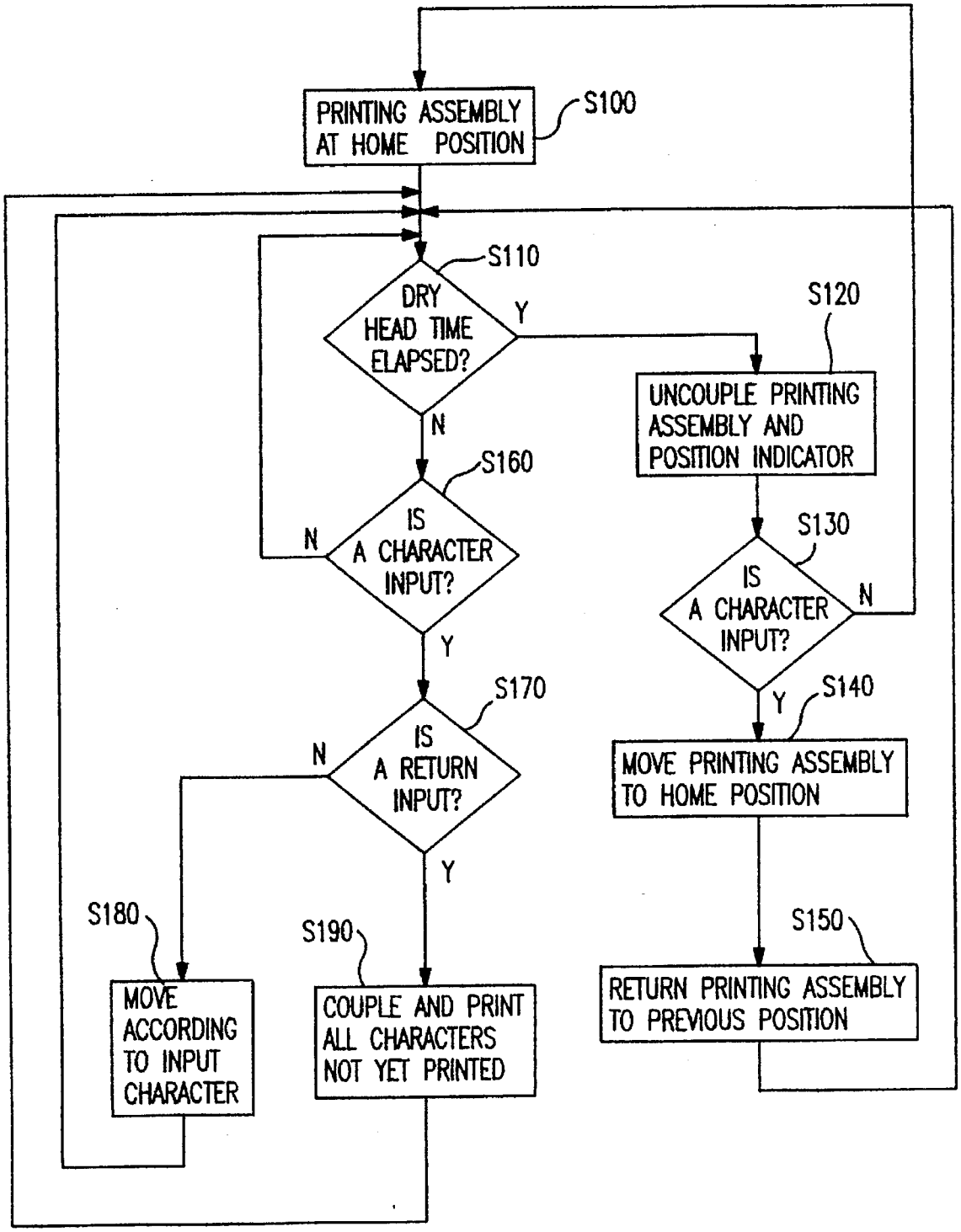
FIG. 9 is a flow chart illustrating another embodiment of a method of the present invention.

As shown in step S100 in FIG. 9, when the printer 1 is turned on, the printing assembly 5 is at the home position and the print head 14 is capped by the print head capping mechanism 11, as seen in FIG. 1A. The print position indicator 7 abuts the right edge of the printing assembly 5, as seen in FIG. 2B, and is uncoupled from the printing assembly 5 because the CPU 25 has previously turned off the power to the electromagnet 16. The printer 1 is awaiting the input of characters, spaces, and tabs from the keyboard 4.

From step S100, the method advances to step S110. In step S110 the CPU 25 determines whether a predetermined dry print head time has elapsed since the print head 14 has printed. This predetermined time is 5 or 10 seconds, depending on the model of the printer 1. The predetermined dry print head time is selected as the maximum time since the last printing operation before the print head 14 must return to the home position from any point along the guide rail 6, to be capped by the print head capping mechanism 11 before drying out. Of course, after the printer 1 is turned on, printing has likely not occurred for some time, and the printing assembly 5 is at the home position capped by the capping mechanism 11. Thus, there would not appear to be a need for step S110. However, a malfunction can occur, moving the printing assembly away from the home position. Without step S110, the print head 14 would dry out if printing does not occur within 5 or 10 seconds. Moreover, after the print head 14 prints, there is a need for the printer 1 to determine whether the predetermined dry print head time has elapsed. Otherwise, if the user pauses and the inputting of characters is stopped for 5 or 10 seconds after printing, the print head 14 may dry out. In order to address this problem, the method returns to step S110 after printing, as will be discussed below.

In step S110 if the CPU 25 determines that the predetermined dry print head time has elapsed, the method advances to step S120 where the CPU 25 maintains the print position indicator 7 uncoupled from the printing assembly 5 by maintaining the electromagnet 16 in an off state or the CPU 25 turns off the electromagnet 16 if it is turned on, thereby uncoupling the print position indicator 7 and the printing assembly 5. Then, the method advances to step S130 where the CPU 25 determines whether a character, a space, or a tab is input with the keyboard 4. If a character is not determined to be input, the method returns to step S100 where the CPU 25 instructs the printing assembly 5 to return to the home position if the printing assembly 5 is not at the home position or maintains the printing assembly 5 at the home position if the printing assembly 5 is located at the home position. If the CPU 25 determines that the keyboard 4 has input a character in step S130, the method advances to step S140, where the CPU 25 instructs the display 9 to display the input character and instructs the printing assembly 5 to move to the home position where the print head 14 will be capped by the print head capping mechanism 11. The method then advances to step S150 where the CPU 25 instructs the printing assembly 5 to return to its previous position, i.e. the position the printing assembly 5 occupied during step S110. Thus, after moving to the home position in response to the lapsing of the predetermined dry print head time, the printing assembly 5 will move back to the last print position as long as there is a character being input. If no character is being input, then the printing assembly 5 stays at the home position after the lapsing of the predetermined dry print head time and remains there until a character is input.

If the CPU 25 determines that the predetermined dry print head time has not elapsed in step S110, the method advances to step S160, where the CPU 25 determines whether a character, a tab, or a space is input from the keyboard 4. If the CPU 25 determines that a character, a tab, or a space is not input in step S160, the method returns to step S110. If the CPU 25 determines that a character, a tab, or a space is input into the printer 1, the method advances to step S170. In step S170, the CPU 25 determines whether a return is input. If a return is not input by the keyboard 4, the method advances to step S180 where the CPU 25 instructs the motor 29 to move the print head carrier 12 to the right to the next position in response to the inputting of a space or a character or instructs the motor 29 to move the print head carrier 12 several positions to the right if a tab was input. In addition, if a character is input, the CPU 25 instructs the display 9 to display the character. The method then returns to step S110. On the other hand, if the CPU 25 determines that a return is input in step S170, the method advances to step S190. In step S190, the CPU 25 turns on the electromagnet 16, coupling the printing assembly 5 to the print position indicator 7. In addition, the CPU 25 instructs the motor 29 to move the print head carrier 12 to the left margin and then to move in the rightward direction while instructing the print head 14 to print the input characters that were input since the last printing operation. As a result, a line of characters is printed only after the entire line is input.

It is within the scope of the present invention for:

1) the printer to be a dot matrix printer, an ink jet printer, a electric typewriter, or any other type of printer;
2) the input device to be a mouse, a receiving device for receiving character and space data from an external device such as a computer, a microphone and voice recognition circuitry, or any other structure for inputting information into the printer;

3) the printing assembly to comprise the print head alone, a print cartridge containing the print head, or any other structure to which the print head is attached which moves the print head for printing;

4) the tip of the position indicator shown in FIGS. 2A and 2B to have any type of configuration, as long as it visually indicates the printing and space positions, such as a cylindrical configuration, an ellipsoidal configuration, a spherical configuration, etc;

5) the light emitting elements to be incandescent elements, laser elements, fluorescent elements, or any other type of elements that emit light;

6) the light source to be a single element, instead of an array of elements;

7) the coupling stud 342 and the uncoupling stud 341 to have a shape other than cylindrical, such as spherical, square, rectangular, or oval, as long as they perform the latching and unlatching functions noted above, 8) the coupling stud 342 to comprise several elements and the uncoupling stud 341 to comprise several elements;

9) the control device to be a microprocessor, a processor, a programmable logic device, an electronically programmable read-only memory, or any other electrical device capable of performing the functions of control device noted above; and 10) the coupling elements 331 and 336 to have any type of configuration and structure, as long as they latch together, unlatch from each other, and maintain their latching and unlatching states under the conditions noted above.

The individual components represented by the blocks shown in FIGS. 4A, 4B, 4C, and 4D and the printer shown in FIGS. 1A and 1B are well known in the printing art and their specific construction and operation is not critical to the invention or the best mode for carrying out the invention. Moreover, the operations discussed in the specification and in FIGS. 7A, 7B and 8 can be easily programmed into well known controllers or central processing units by persons of ordinary skill in the art, and since such programming per se is not part of the invention, no further description thereof is deemed necessary.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims.

We claim:

1. An ink jet printer for printing on a recording medium comprising:

a guide rail;

an ink jet print head slidably mounted on said guide rail for left-and-right movement adjacent the recording medium;

a motor configured and positioned to move said ink jet print head left and right on said guide rail;

a print position indicator slidably mounted on said guide rail, to the right of said ink jet print head, for left-and-right movement adjacent the recording medium, said print position indicator comprising a laterally extending array of a plurality of light emitting elements configured to illuminate a plurality of next print positions at which printing will next occur;

a keyboard configured to input characters into said ink jet printer; and control means for controlling said ink jet printer so that said ink jet print head moves along said guide rail and prints characters input by said keyboard;

said control means controlling said ink jet printer to operate in a queue mode in which said control means controls said motor to refrain from moving said ink jet print head and controls said ink jet print head to refrain from printing during the input of characters by said keyboard until a predetermined number of characters have been input by said keyboard, said control means sequentially illuminating said plurality of light emitting elements to indicate the next print positions during the input of the predetermined number of characters by said keyboard while said ink jet print head refrains from moving and printing, and said control means controlling said motor to move said print head after the predetermined number of characters have been input by said keyboard and controlling said ink jet print head to print the input characters after the predetermined number of characters have been input by said keyboard.

2. The printer defined by claim 1, further comprising:

a coupling mechanism configured to couple said ink jet print head to said print position indicator and to uncouple said ink jet print head from said print position indicator; and a capping mechanism mounted at a home position and configured to engage said ink jet print head when said ink jet print head is located at the home position;

said control means controlling said coupling mechanism to couple said ink jet print head to said print position indicator and to uncouple said ink jet print head from said print position indicator;

said control means controlling said coupling mechanism to uncouple said ink jet print head from said print position indicator or to maintain said ink jet print head uncoupled from said print position indicator, in response to the elapsing of a predetermined period of time since said ink jet print head has printed, said control means controlling said motor to move said ink jet print head to the home position in response to the elapsing of a predetermined period of time since said ink jet print head has printed, and said control means activating said capping mechanism to cap said ink jet print head at the home position in response to the elapsing of the predetermined period of time since said ink jet print head has printed.

3. The printer defined by claim 2, wherein said control means verifies the spelling of an inputted word inputted by said keyboard when said control means determines that the word is completely input and said control means sets a spell verify mode, wherein said control means controls said printer to operate in the queue mode when controlling said printer to operate in a spell verify mode or when said ink jet print head is at the home position capped by said capping mechanism.

4. The printer defined by claim 1, wherein to indicate one next print position said control means illuminates only a predetermined number of the light emitting elements closest to the one next print position.

5. The printer defined by claim 1, wherein said print position indicator further comprises a counter connected to said control means and to said plurality of light emitting elements, said counter and said control means controlling the order of illumination of said plurality of light emitting elements.

6. The printer defined by claim 5, said ink jet print head being configured to characters having a plurality of fonts, said control means instructing said counter to illuminate a predetermined number of light emitting elements to indicate one next print position, the predetermined number of light emitting elements being determined in accordance with the size of the font of the character, input by said keyboard, to be printed at the indicated next print position, and said counter illuminating the predetermined number of light emitting elements in response to the instructing by said control means.

7. The printer defined by claim 1, said control means selecting a font size for characters to be printed by said ink jet print head, and said control means illuminating a predetermined number of said plurality of light emitting elements in accordance with the selected font size.

8. A method of indicating a position on a recording medium at which a print head of a printing assembly of a printing apparatus will print, said method comprising the steps of:

positioning the print head at a print position on the recording medium;

visually indicating a next print position at which the print head of the printing assembly will print on the recording medium with a print position indicator substantially adjacent the recording medium, the print position indicator being controllably and detachably coupled to the printing assembly so as to allow for a mechanical coupling of said position indicator to the printing assembly and a mechanical uncoupling of said position indicator from the printing assembly; and continuing to indicate the next print position even when the print head is no longer adjacent the next print position in the event the print position indicator is uncoupled from the printing assembly and the printing assembly moves away from the print position or in the event the print position indicator indicates a next print position not adjacent the print head.

9. The method defined by claim 8, further comprising the step of:

uncoupling the print position indicator from the printing assembly or maintaining the print position indicator uncoupled from the printing assembly when a dry print head time has elapsed and the printing apparatus determines that the print head is to move to a home position at which the print head will be capped to prevent drying out of the print head.

10. The method defined by claim 8, further comprising the steps of:

coupling the print position indicator to the printing assembly when a backspace is input into the printing apparatus; and uncoupling the print position indicator from the printing assembly after the printing assembly has performed a backspace operation in response to the inputting of the backspace into the printing apparatus.

11. The method defined by claim 8, further comprising the steps of:

coupling the print position indicator to the printing assembly when a return is input into the printing apparatus or when the printing assembly reaches a right margin; and uncoupling the print position indicator from the printing assembly after the print head moves to the left in response to the inputting of the return into the printing apparatus or the reaching of the right margin by the printing assembly.

12. The method defined by claim 8, wherein the printing apparatus includes a first coupling element integrally connected to the printing assembly, the first coupling element comprising an electromagnet, wherein the print position indicator comprises a second coupling element thereon, the second coupling being composed at least partially of a material attracted to the electromagnet when the electromagnet is turned on, the second coupling element being coupleable to the first coupling element to couple the print position indicator to the printing assembly when the electromagnet is turned on, the second coupling element also being uncoupleable from the first coupling element to uncouple the print position indicator from the printing assembly when the electromagnet is turned off, said method further comprises the steps of:

turning on the electromagnet to couple the print position indicator to the printing assembly; and turning off the electromagnet to uncouple the print position indicator from the printing assembly.

13. The method defined by claim 8, wherein the printing assembly comprises the print head and a print head carrier carrying the print head, wherein the printing apparatus includes a first coupling element attached to the print head carrier and rotatable to and away from a first position, wherein the print position indicator comprises a second coupling element thereon, the second coupling element comprising a pin moveable to a coupling position at which the pin engages the first coupling element when the first coupling element is in the first position, said method further comprises the steps of:

rotating the first coupling element away from the first position when the first coupling element engages the pin to disengage the first and second coupling elements and uncouple the print head carrier from the print position indicator; and moving the pin to the coupling position when the first coupling element is disengaged from the second coupling element and at the first position to engage the first and second coupling elements and couple the print head carrier to the print position indicator.

14. The method defined by claim 8, wherein the print position indicator comprises a plurality of light emitting elements configured to illuminate a plurality of next print positions, at least one of which is not adjacent the print head, said method further comprising the step of:

illuminating a next print position not adjacent the print head.

15. An apparatus for indicating a position on a recording medium at which a print head of a printing assembly of a printing apparatus will print, said apparatus comprising:

a position indicator substantially adjacent the recording medium and configured to visually indicate a next print position on the recording medium, said position indicator being controllably and detachably coupled to the printing assembly so as to allow for a mechanical coupling of said position indicator to the printing assembly and a mechanical uncoupling of said position indicator from the printing assembly, and said position indicator continuing to indicate the next print position even when the print head is no longer adjacent the next print position.

16. The apparatus defined by claim 15, further comprising control means for controlling the coupling of said position indicator to the printing assembly and the uncoupling of said position indicator from the printing assembly, said control means causing the uncoupling of said position indicator from the printing assembly or the maintaining of said position indicator uncoupled from the printing assembly when a dry print head time has elapsed and the printing apparatus determines that the print head is to move to a home position at which time the print head will be capped to prevent drying out of the print head.

17. The apparatus defined by claim 15, further comprising control means for controlling the coupling of said position indicator to the printing assembly and the uncoupling of said position indicator from the printing assembly, said control means causing the coupling of said position indicator to the printing assembly when a backspace is input into the printing apparatus and causing the uncoupling of said position indicator from the printing assembly after the printing assembly has performed a backspace operation in response to inputting of the backspace into the printing apparatus.

18. The apparatus defined in claim 15, further comprising control means for controlling the coupling of said position indicator to the printing assembly and the uncoupling of said position indicator from the printing assembly, said control means causing the coupling of said position indicator to the printing assembly when a return is input into the printing apparatus or when the printing assembly reaches a right margin, and causing the uncoupling of said position indicator from the printing assembly after the print head moves left in response to inputting of the return into the printing apparatus or reaching of the right margin by the printing assembly.

19. The apparatus defined by claim 15, wherein the printing apparatus includes a first coupling element integrally connected to the printing assembly, said position indicator comprising a second coupling element thereon, said second coupling element being coupleable to the first coupling element to couple said position indicator to the printing assembly, said second coupling element also being uncoupleable from the first coupling element to uncouple said position indicator from the printing assembly.

20. The apparatus defined by claim 19, the first coupling element comprising an electromagnet, and said second coupling element being composed at least partially of a material attracted to the electromagnet when the electromagnet is turned on.

21. The apparatus defined by claim 19, wherein the printing assembly comprises the print head and a print head carrier carrying the print head, wherein the first coupling element is rotatably mounted on the print head carrier and projects below the print head carrier, wherein the printing apparatus further comprises a spring biasing the first coupling element toward a first position at which the first coupling element can be coupled to said second coupling element if said second coupling element is at a coupling position, said second coupling element comprising a pin slidably mounted beneath said position indicator, said pin slidable into the coupling position at which said second coupling element can be coupled to the first coupling element when the first coupling element is in the first position.

22. The apparatus defined by claim 15, wherein said print position indicator comprises a plurality of light emitting elements configured to illuminate a plurality of next print positions, at least one of which is not adjacent the print head.

23. An ink jet printer for printing on a recording medium comprising:

a guide rail;

an ink jet print head slidably mounted on said guide rail for left-and-right movement adjacent the recording medium;

a print position indicator slidably mounted on said guide rail, for left-and-right movement adjacent the recording medium, said print position indicator being positioned and configured to continuously indicate the next print position;

a coupling mechanism configured to couple said ink jet print head to said print position indicator and to uncouple said ink Jet print head from said print position indicator;

a capping mechanism mounted at a home position and configured to engage said ink jet print head when said ink jet print head is located at the home position;

a keyboard configured to input characters into said printer; and control means for controlling said ink jet print head to move along said guide rail and to print characters input by said keyboard and for controlling said coupling mechanism to couple said ink jet print head to said print position indicator and to uncouple said ink jet print head from said print position indicator, wherein said print position indicator is pushed along said guide rail to indicate the next print position in response to said ink jet print head moving along said guide rail, said control device controlling said coupling mechanism to uncouple said ink jet print head from said print position indicator or to maintain said ink jet print head uncoupled from said print position indicator, controlling said ink jet print head to move to the home position, and activating said capping mechanism to cap said ink jet print head at the home position in response to the elapsing of a predetermined period of time since said ink jet print head has printed, said print position indicator remaining at the next print position on said guide rail to indicate the next print position when said ink jet print head moves to the home position.

24. The printer defined by claim 23, further comprising a print head carrier supporting said ink jet print head, said print head carrier being slidably mounted on said guide rail for left-and-right movement adjacent the recording medium, said ink jet print head being slidably mounted on said guide rail via said print head carrier, wherein a portion of said coupling mechanism is attached to said print head carrier.

25. The printer defined by claim 23, wherein said print position indicator comprises a plurality of light emitting elements configured to illuminate a plurality of print positions, and wherein said control means instructs the illumination of only a predetermined number of the light emitting elements closest to the next print position to indicate the next print position.

26. The printer defined by claim 23, further comprising a motor configured and positioned to move said ink jet print head left and right along said guide rail, said control means controlling said motor, said control means controlling said motor to move said ink jet print head along said guide rail to a right margin in response to the inputting of a sufficient number of characters by said keyboard, said keyboard configured to input a backspace and a return into said printer, said control means controlling said motor to move said ink jet print head to the left in response to the inputting of a backspace by said keyboard, and said control means controlling said coupling mechanism to uncouple said ink jet print head from said print position indicator or to maintain said ink jet print head uncoupled from said print position indicator when characters are input by said keyboard, as long as the right margin has not been reached by said ink jet print head or a backspace or a return has not been input by said keyboard.

27. The printer defined by claim 23, further comprising a motor configured and positioned to move said ink jet print head left and right along said guide rail, said control means controlling said motor, said keyboard being configured to input a backspace into said printer, said control means controlling said motor to move said ink jet print head to the left along said guide rail to perform a backspace operation in response to the inputting of a backspace by said keyboard, and said control means controlling said coupling mechanism to cause the coupling of said ink jet print head to said print position indicator in response to the inputting of a backspace by said keyboard and to cause the uncoupling of said ink jet print head from said print position indicator after said ink jet print head has performed the backspace operation.

28. The printer defined by claim 23, further comprising a motor configured and positioned to move said ink jet print head left and right along said guide rail, said control means controlling said motor, said ink jet print head being movable to a right margin by said motor, said keyboard being configured to input a return into said printer, and said control means controlling said coupling mechanism to cause the coupling of said ink jet print head to said print position indicator when a return is input by said keyboard or when said ink jet print head reaches the right margin, said control means controlling said motor to move said ink jet print head to the left after controlling said coupling mechanism to cause the coupling of said ink jet print head to said print position indicator in response to the inputting of a return by said keyboard or the reaching of the right margin by said ink jet print head, and said control means controlling said coupling mechanism to uncouple said ink jet print head from said print position indicator after said ink jet print head moves to the left in response to the inputting of the return by said keyboard or the reaching of the right margin by said ink jet print head.

29. The printer defined by claim 23, further comprising a motor configured and positioned to move said ink jet print head left and right along said guide rail, said control means controlling said motor, said keyboard being configured to input a return and a backspace into said printer, said coupling mechanism comprising a first coupling element attached to said print head and a second coupling element attached to said print position indicator, said first and second coupling elements being positioned and configured to engage each other to couple said print position indicator to said ink jet print head and to disengage each other to uncouple said print position indicator from said ink jet print head, said printer further comprising:

a coupling stud being configured and positioned so as to contact said second coupling element to cause said second coupling element to engage said first coupling element when said ink jet print head, uncoupled from said print position indicator, moves to its farthest right position along said guide rail; and an uncoupling stud being configured and positioned so as to contact said first coupling element to cause said first coupling element to disengage said second coupling element when said ink jet print head, coupled to said print position indicator, reaches the home position, said control means controlling said motor to move said ink jet print head to its farthest right position so that said second coupling element contacts said coupling stud in response to said ink jet print head reaching a right margin when a predetermined number of characters and spaces are input by said keyboard, in response to a return being input by said keyboard, in response to a backspace being input by said keyboard, or in response to determining that said ink jet print head is to move to the home position to be capped by said capping mechanism, and said control means controlling said motor to move said ink jet print head to the home position so that said first coupling element contacts said uncoupling stud after said ink jet print head reaches its farthest right position and said second coupling element contacts said coupling stud.

30. The printer defined by claim 23, said coupling mechanism comprising a first coupling element attached to said print head and a second coupling element attached to said print position indicator, said first and second coupling elements being positioned and configured to engage each other to couple said print position indicator to said ink jet print head and to disengage each other to uncouple said print position indicator from said ink jet print head, said first coupling element comprising an electromagnet, said second coupling element being composed, at least partially, of a material attracted to said electromagnet when said electromagnet is turned on, and said control means turning on said electromagnet when determining to couple said ink jet print head to said print position indicator.

31. A method of printing on a recording medium with a ink jet print head of a ink jet printer and of indicating a position on the recording medium at which the ink jet print head will next print, said method comprising the steps of:

inputting a character into the ink jet printer;

moving the ink jet print head on a guide rail of the ink jet printer and printing the input character;

pushing a print position indicator, slidably mounted on the guide rail, to the next print position with the moving ink jet print head as the ink jet print head prints the input character, and indicating the next print position with the print position indicator;

determining whether a predetermined time has elapsed since the ink jet print head has printed;

uncoupling the ink jet print head from the print position indicator or maintaining the ink jet print head uncoupled from the print position indicator, moving the ink jet print head to a home position, and activating a capping mechanism at the home position to cap the ink jet print head at the home position in the event said determining step determines that the predetermined time has elapsed; and maintaining the print position indicator at the next print position and continuing to indicate the next print position with the print position indicator when the ink jet print head moves to the home position.

32. The method defined by claim 31, wherein the print position indicator comprises a plurality of light emitting elements configured to illuminate a plurality of print positions, said indicating step and said continuing to indicate step comprising the step of:

illuminating only a predetermined number of the light emitting elements closest to the next print position to indicate the next print position.

33. The method defined by claim 31, further comprising the steps of:

inputting a plurality of characters into the ink jet printer with a keyboard configured to input a backspace and a return into the ink jet printer;

moving the ink jet print head along the guide rail to a right margin in response to the inputting of a sufficient number of characters in said inputting step;

moving the ink jet print head to the left in response to the inputting of a backspace by the keyboard; and uncoupling the ink jet print head from the print position indicator or maintaining the ink jet print head uncoupled from the print position indicator when the plurality of characters are input by the keyboard in said inputting step, as long as the right margin has not been reached by the ink jet print head or a backspace or a return has not been input by the keyboard.

34. The method defined by claim 31, wherein said inputting step is performed with a keyboard configured to input a backspace into the ink jet printer, wherein said method further comprises the steps of:

moving the ink jet print head to the left along the guide rail to perform a backspace operation in response to the inputting of a backspace by the keyboard;

coupling the ink jet print head to the print position indicator in response to the inputting of a backspace by the keyboard; and uncoupling the ink jet print head from the print position indicator after the ink jet print head has performed the backspace operation.

35. The method defined by claim 31, wherein the ink jet print head is movable to a right margin along the guide rail, wherein said inputting step is performed with a keyboard configured to input a return into the ink jet printer, said method further comprising the steps of:

coupling the ink jet print head to the print position indicator when a return is input by the keyboard or when the ink jet print head reaches the right margin, moving the ink jet print head to the left after said coupling step; and uncoupling the ink jet print head from the print position indicator after said left moving step.

36. The method defined by claim 31, wherein said inputting step is performed by a keyboard configured to input a return and a backspace into the ink jet printer, wherein the keyboard is configured to input a plurality of characters into the ink jet printer, wherein the ink jet printer comprises a first coupling element attached to the ink jet print head and the print position indicator comprises a second coupling element configured to engage and disengage the first coupling element to couple and uncouple the ink jet print head to and from the print position indicator, respectively, said method further comprising the steps of:

moving the ink jet print head to the right margin in the event that the keyboard inputs a sufficient number of characters into the ink jet printer;

moving the ink jet print head to its farthest right position at which a coupling stud of the ink jet printer pushes the second coupling element into engagement with the first coupling element in response to said right margin moving step, in response to a return being input by the keyboard, in response to a backspace being input by the keyboard, or in response to said determining in said determining step that the predetermined time has elapsed; and moving the ink jet print head to the home position at which an uncoupling stud of the ink jet printer pushes the first coupling element out of engagement with the second coupling element after said farthest right position moving step.

37. The method defined by claim 31, wherein the ink jet printer further comprises an electromagnet connected to the ink jet print head, wherein the print position indicator is composed at least partially of a material attractable to the electromagnet when the electromagnet is turned on, said method further comprising the steps of:

turning on the electromagnet to couple the print position indicator to the ink jet print head, wherein said uncoupling step comprises the step of turning off the electromagnet or maintaining the electromagnet in a turned off state.

38. A method of printing on a recording medium with a ink jet print head of a ink jet printer and of indicating a position on the recording medium at which the ink jet print head will next print, said method comprising the steps of:

moving the ink jet print head along a guide rail of the ink jet printer to a print position;

pushing a print position indicator, slidably mounted on the guide rail to the right of the ink jet print head, with the moving ink jet print head, the print position indicator comprising a laterally extending array of a plurality of light emitting elements configured to illuminate a plurality of next print positions at which printing will next occur;

inputting a plurality of characters into the ink jet printer;

refraining from moving the ink jet print head and refraining from printing with the ink jet print head during the inputting of characters in said inputting step until a predetermined number of characters have been inputted;

sequentially illuminating the plurality of light emitting elements to indicate the next print positions during the inputting of the predetermined number of characters in said inputting step while the ink jet print head refrains from moving and printing; and moving the ink jet print head and printing the input characters with the ink jet print head after the predetermined number of characters have been input in said inputting step.

39. The method defined by claim 38, further comprising the steps of:

determining whether a predetermined time has elapsed since the ink jet print head has printed;

uncoupling the ink jet print head from the print position indicator or maintaining the ink jet print head uncoupled from the print position indicator, in response to the determining in said determining step of the elapsing of the predetermined time;

moving the ink jet print head to the home position in response to said determining step determining the elapsing of the predetermined time; and activating a capping mechanism, located at the home position, to cap the ink jet print head at the home position in response to said determining step determining the elapsing of the predetermined time, wherein said inputting, refraining, sequential illuminating, and moving and printing steps are performed after said activating step.

40. The method defined by claim 38, further comprising the steps of:

setting a spell verify mode before said inputting step; and determining whether a complete word is input in said inputting step;

verifying the spelling of the inputted word after said setting step and after said determining step determines that a complete word is input, wherein said refraining step is performed during said determining and verifying steps.

41. The method defined by claim 38, wherein to indicate one next print position said sequential illuminating step illuminates only a predetermined number of light emitting elements closest to the one next print position.

42. The method defined by claim 38, wherein said sequential illuminating step is controlled by a counter and a central processing unit.

43. The method defined by claim 38, wherein the ink jet print head is configured to print characters having a plurality of fonts, wherein said method further comprises the step of:

selecting a font for the characters to be printed by the ink jet print head, wherein said sequential illuminating step comprises the steps of:

determining the number of light emitting elements to be illuminated to indicate the next print position in accordance with the size of the font selected in said selecting step; and illuminating the number of light emitting elements determined in said determining step to indicate the next print position.

* * * * *